US005617802A

United States Patent [19]

Cash

[11] Patent Number: 5,617,802

[45] Date of Patent: Apr. 8, 1997

[54] MULTI-NEEDLE BORDER MACHINE HAVING FOLDERS

[75] Inventor: David R. Cash, Louisville, Ky.

[73] Assignee: James Cash Machine Co., Inc., Louisville, Ky.

[21] Appl. No.: 532,218

[22] Filed: Sep. 22, 1995

Related U.S. Application Data

[63] Continuation-in-part of Ser. No. 439,963, May 12, 1995, Pat. No. 5,509,365.

[51] Int. Cl.[6] ..... D05B 11/00

[52] U.S. Cl. ..... 112/117; 112/305; 112/147

[58] Field of Search ..... 112/7, 8, 117–119, 112/147, 153, 163, 305, 307, 322, 2.1, 475.23, 470.13

[56] References Cited

U.S. PATENT DOCUMENTS

| | | | |
|---|---|---|---|
| 1,908,972 | 5/1933 | Gail | 112/117 |
| 2,791,344 | 5/1957 | Kalning et al. | 112/470.13 X |
| 4,432,296 | 2/1984 | Grondin | 112/475.23 |
| 5,509,365 | 4/1996 | Cash | 112/117 |

FOREIGN PATENT DOCUMENTS

| | | | |
|---|---|---|---|
| 2154359 | 2/1971 | Germany | 112/117 |
| 80481 | 5/1985 | Japan | 112/117 |

*Primary Examiner*—Ismael Izaguirre
*Attorney, Agent, or Firm*—Middleton & Reutlinger; James C. Eaves, Jr.

[57] ABSTRACT

A multi-needle border machine having folders employable, for example, in mattress manufacturing. A multi-needle quilter for sewing mattress top pieces can be converted to sew one or many border pieces or a smaller version employing the same multi-needle technology can be made which can sew simultaneously, for example, one to three border pieces. For example, the machine is used to sew a mattress border piece including a ticking and a filler such as foam, the border having a des mired sewn pattern thereon. The border is the piece which goes around the sides of the mattress. By folding the edges of the ticking before sewing and by sewing so that the pattern sews into the folded areas, the need for a separate border serger is eliminated. By balancing machine components, the weight of the machine can be greatly reduced.

13 Claims, 20 Drawing Sheets

3
3

MULTI-NEEDLE BORDER MACHINE HAVING FOLDERS

BACKGROUND OF THE INVENTION

This application is a continuation-in-part application of my U.S. patent application No. 08/439,963, filed May 12, 1995, for a multi-needle quilting machine, incorporated herein by reference. That application is now U.S. Pat. No. 5,509,365, issued Apr. 23, 1996.

FIELD OF THE INVENTION

The present invention relates to a multi-needle border machine having folders employable, for example, in mattress manufacturing. A multi-needle quilter for sewing mattress top pieces can be converted to sew one or many border pieces or a smaller version employing the same multi-needle technology can be made which can sew simultaneously, for example, one to three border pieces. For example, the machine is used to sew a mattress border piece including a ticking and a filler such as foam, the border having a desired sewn pattern thereon. The border is the piece which goes around the sides of the mattress. By folding the edges of the ticking before sewing and by sewing so that the pattern sews into the folded areas, the need for a separate border serger is eliminated. By balancing machine components, the weight of the machine can be greatly reduced.

SUMMARY OF THE INVENTION

The present invention is for a multi-needle sewing machine used to sew mattress border pieces having mattress ticking and filler such as foam, the border having a desired sewn pattern thereon. Prior to sewing, the ticking has its sides folded under. The sewing process sews into the folded areas at desired locations, depending on the pattern and number of needles employed. This folded edge eliminates the need for serging the border piece.

In the multi-needle quilting machine of my parent application, the ticking/filler/backing are pulled straight through the quilter. A front needle bar and parallel rear needle bar spaced therefrom, the bars having needles at preselected locations, are moved left and right, with respect to the movement of the ticking/filler/backing, to create the desired pattern. The front and rear needle bars are operated in an out of phase relationship, that is, when the front needle bars are moving down, the rear needle bars are moving up. Also, movements of the needle bar cranks can be set such that the cranks for the front needle bars rotate in one direction and cranks for the rear needle bars rotate in the opposite direction. This helps permit the weight of the quilter to be reduced.

In making a two thread chain stitch, needles and associated presser feet, spreaders, and loopers are employed, the spreaders and loopers being below the material being sewn. The spreaders are moved in a circular path in a single plane which is accomplished by off-set bores in the end of a rotating spreader shaft. The loopers require more complicated movement. The loopers move in a somewhat oblong path. The loopers are moved left and right and, also, rocked front and back to create the oblong path. A spreader rotating shaft has a looper rotating shaft transverse thereto. Transverse gears on both shafts engage so that the rotation of the spreader shaft rotates the transverse shaft. A looper crank on each end of the spreader shaft, the looper cranks having off-set bores therein, is used to create the left and right movement of the loopers. Eccentrics are used to rock the loopers front and back.

This multi-needle quilter can be easily modified, so that, instead of pulling comparatively wide width ticking/filler/backing through the machine for quilting, one or more narrow pieces of ticking/filler can be pulled through the machine to make border. By including a left and right folder for each border piece so that the ticking edges are folded under prior to sewing, the border piece, by sewing into the folded edge areas, will not require later serging. Serging requires much more thread than this process and is an additional unrequired step. Also, with this process, the filler does not extend all the way to the border edges. The border edges are simply a folded double thickness of ticking. Therefore, the tape edge operator has less thickness to sew through than with serged border pieces.

In addition to a modified multi-needle quilter, a smaller width version of the quilter can be made solely for making border. For example, the preferred multi-needle border machine taught herein can sew one or two border pieces.

Finally, the present invention comprises a multi-needle sewing machine including: a sewing frame carriage having at least one upper sewing assembly and a lower sewing assembly, the at least one upper sewing assembly having an upper main shaft passing therethrough, the lower sewing assembly having a lower main shaft passing therethrough, the sewing frame carriage having means for driving the upper and lower main shafts; the at least one upper sewing assembly having a front needle bar having at least one needle connected thereto; the at least one upper sewing assembly having a corresponding front presser foot bar having at least one presser foot connected thereto; the at least one upper sewing assembly having a rear needle bar having at least one needle connected thereto; the at least one upper sewing assembly having a corresponding rear presser foot bar having at least one presser foot connected thereto; the at least one upper sewing assembly having means for driving the front needle bar and the corresponding front presser foot bar and the rear needle bar and the corresponding rear presser foot bar vertically up and down, the driving means being coupled to the upper main shaft, where driving means moves the front needle bar with the corresponding front presser foot bar and the rear needle bar with the corresponding rear presser foot bar in an out of phase relationship; the lower sewing assembly having a front spreader bar having at least one spreader connected thereto; the lower sewing assembly having a corresponding front looper bar having at least one looper connected thereto; the lower sewing assembly having a rear spreader bar having at least one spreader connected thereto; the lower sewing assembly having a corresponding rear looper bar having at least one looper connected thereto; the lower sewing assembly having means for driving the front spreader in a first horizontal circle and the rear spreader bar in a second out of phase horizontal circle, the driving means being coupled to the lower main shaft; the lower sewing assembly having means for driving the front looper bar in a left and right direction and means for rocking the front looper in a front and back direction, where the front looper bar moves in a first oblong pattern; the lower sewing assembly means for driving the front looper bar in a left and right direction also driving the rear looper bar in an out of phase right and left direction, the means for rocking the front looper in a front and back direction also rocking the rear looper bar in an out of phase left and right direction, where the rear looper bar moves in a second out of phase oblong pattern; the machine further having means for pulling a first material and a second material between the upper and lower sewing assemblies, the first material having opposed edges, the machine even further having means for placing the first material being pulled under tension and means for folding the opposed edges of the first material underneath the first material, where the machine sews through the first material and the opposed edges folded thereunder at preselected locations, thereby producing a sewn border piece.

BRIEF DESCRIPTION OF THE DRAWINGS

A better understanding of the present invention will be had upon reference to the following description in conjunction with the accompanying drawings, wherein.

DETAILED DESCRIPTION OF THE PREFERRED EMBODIMENT

Figure 1:
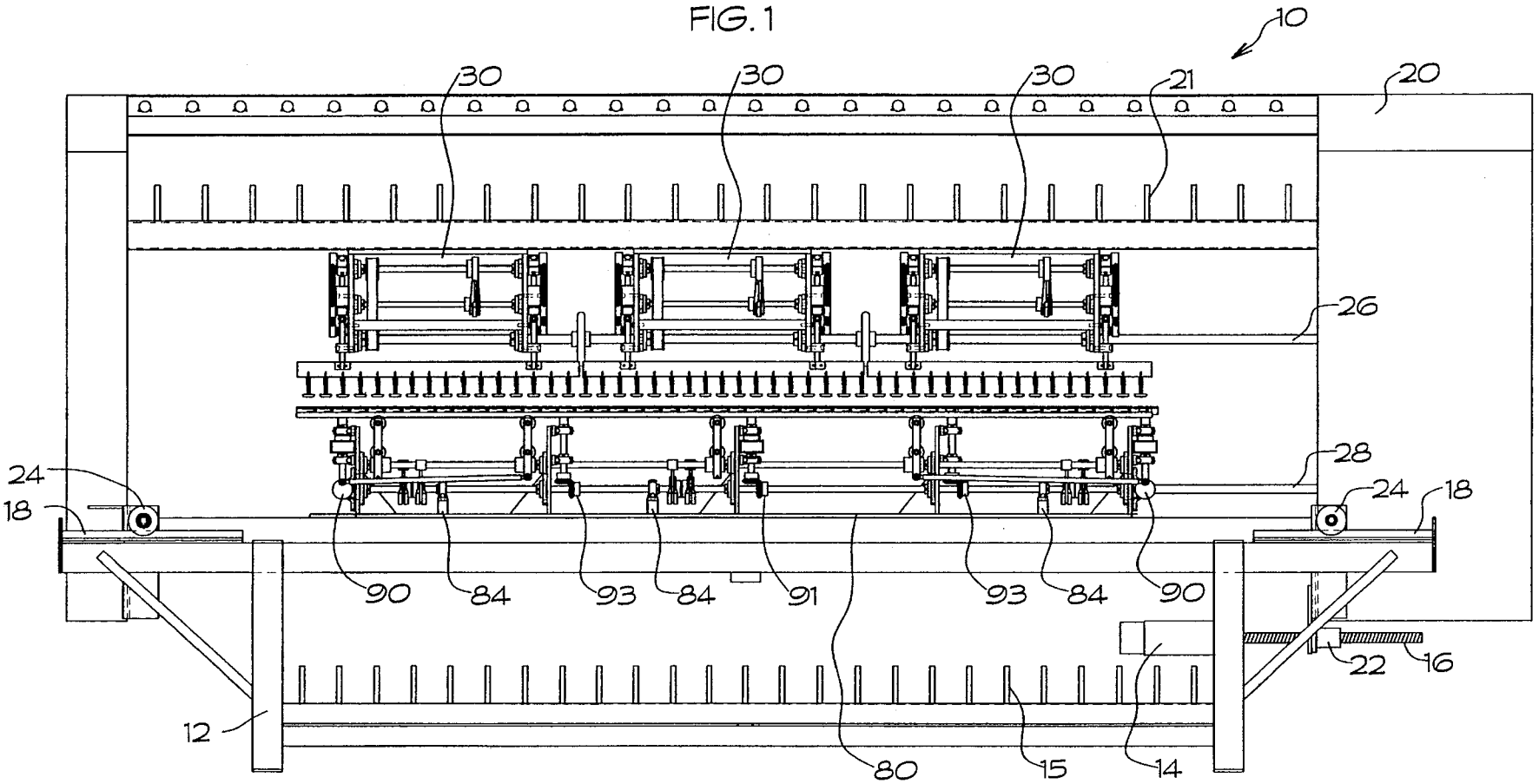
FIG. 1 shows a front view of a multi-needle quilter of the present invention.

With reference to FIG. 1, the multi-needle quilter 10 of the instant invention is shown having a base frame 12 and a sewing frame or carriage 20. The pull rollers which pull the sewn ticking/foam/backing, for example, are not shown, nor are the assemblies which retain the individual ticking, foam, and backing components and receive the completed product. These are shown and discussed with the multi-needle border machine of FIGS. 29–31 hereinafter.

The multi-needle quilter 10 is shown having a capability of up to 99 needles and for sewing a standard width of 86 inches (218½ centimeters). However, these are not limiting to the present invention, as, for other quilting operations, other needle configurations and sewing widths would be used by those skilled in the art.

The base frame 12 includes a motor 14 which drives screw 16. Base frame 12 also includes channels 18. Sewing frame 20 includes a threaded bore portion 22 which receives screw 16. Frame 20 includes rollers 24 which are received by respective channels 18. Motor 14 is operated as desired, for example, by a computer controller, not shown, to turn screw drive 16. This causes sewing frame 20 to move left or right, depending on the rotation of screw drive 16. For example, frame 20 can be moved left/right about 14 inches (35.5 centimeters). The ticking/foam/backing is pulled straight through the quilter 10. With a desired number of needles at desired Locations, the controlled left/right movement of frame 20 causes desired patterns to be sewn. With left/right movement of the frame 20, the forward movement of the ticking/foam/backing can be variably controlled to ensure an equal spacing between the stitches, if desired.

Quilter 10 is designed to sew a standard type 401 two thread lock chain stitch. To do so, needles, spreaders, loopers, and presser feet are employed. With the orientation of FIG. 1, the needles and presser feet are moved vertically up and down, the spreaders are moved in a circle in a horizontal plane, and the loopers are moved left/right and "rocked" front/back to create an oblong movement. FIG. 1 shows a plurality of top thread bars 21 which hold spools of thread, not shown. Thread from each upper spool is fed to a needle. To provide the second thread, base frame 12 contains similar thread bars 15, each which can receive a spool of thread.

Throat plates cover the spreader/looper portions. The throat plates have bores which receive the needles. For example, the presser feet move vertically downward to about ⅝ inch (1.6 centimeter) of the throat plates. The quilter 10 is designed, for example, to sew up to 1½ inch (3.8 centimeter) thick foam filler without adjustment.

Quilter 10 is designed to have counter-balancing movements to permit the machine to be of greatly reduced weight over prior art machines. Quilter 10 is also designed with sealed bearings for oil-free operation.

Figure 3:
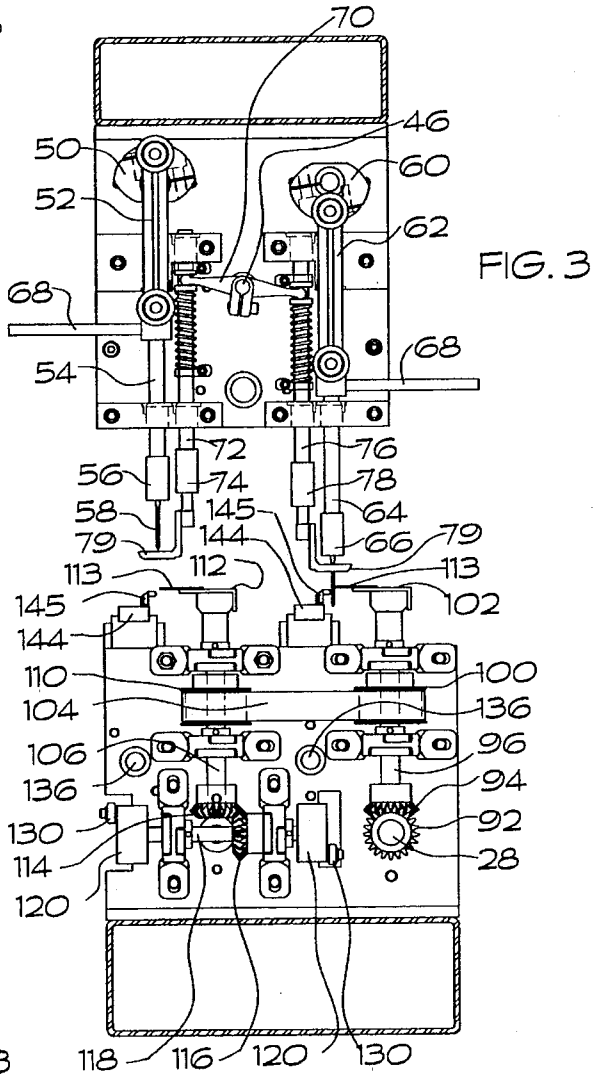
FIGS. 3, 5, 7, 9, 11, 13, 15, 17, 19, 21, 23, and 25 show respective side views of the quilter portion of FIGS. 2, 4, 6, 8, 10, 12, 14, 16, 18, 20, 22, and 24.
Figure 2:
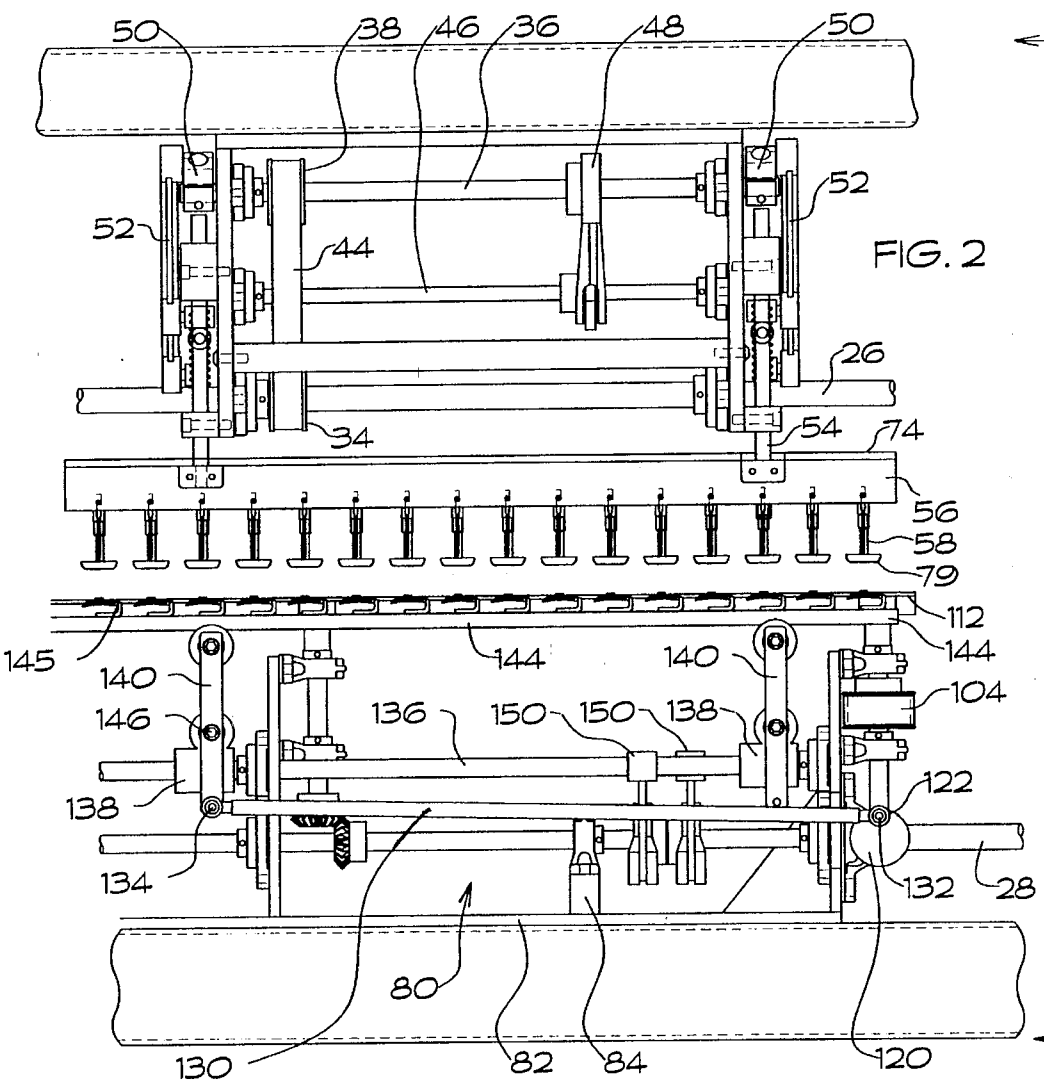
FIGS. 2, 4, 6, 8, 10, 12, 14, 16, 18, 20, 22, and 24 show front views of a selected portion of the quilter of FIG. 1, each next view showing the sewing movement with the needle bar cranks advanced thirty degrees.
Figure 5:
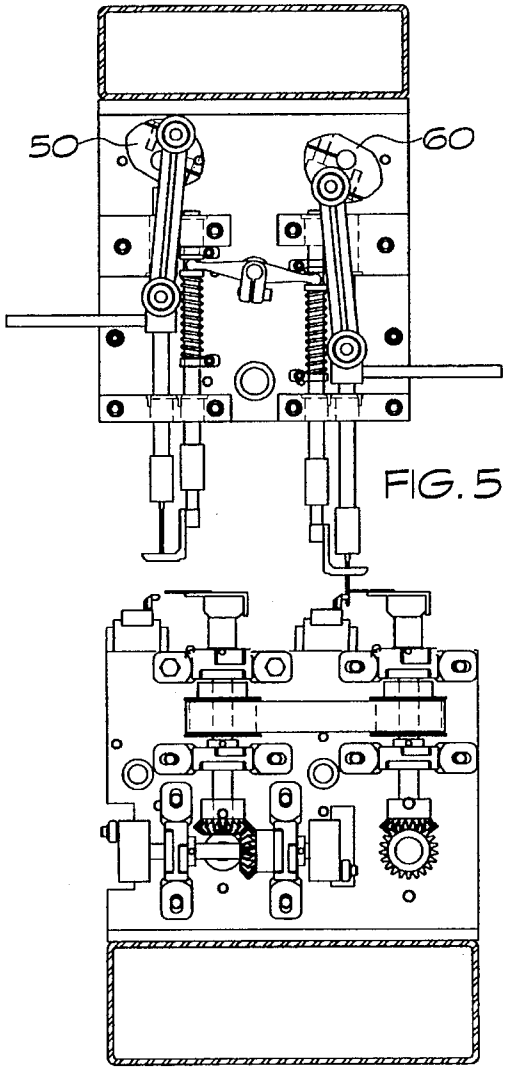
Figure 4:
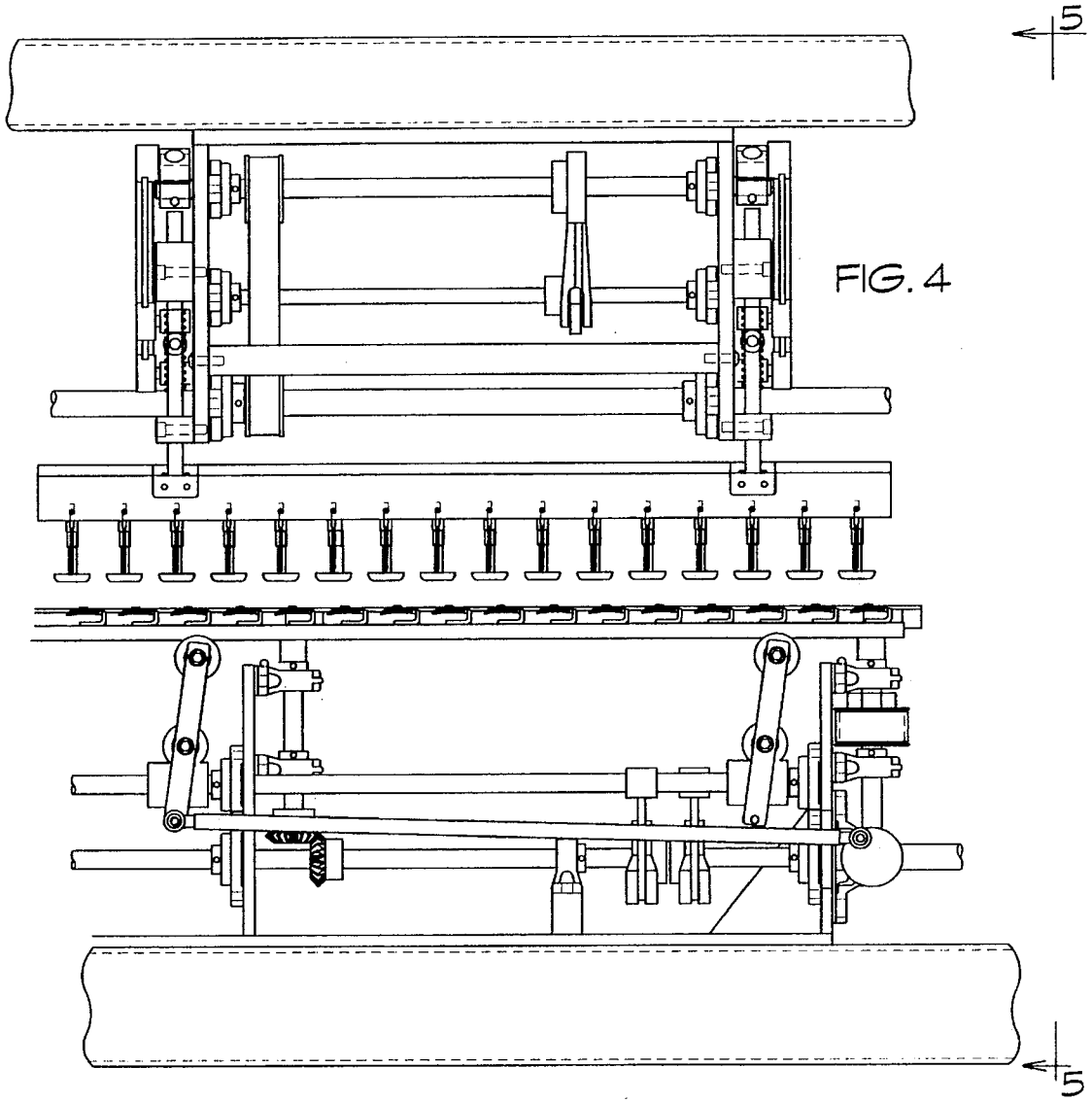
Figure 7:
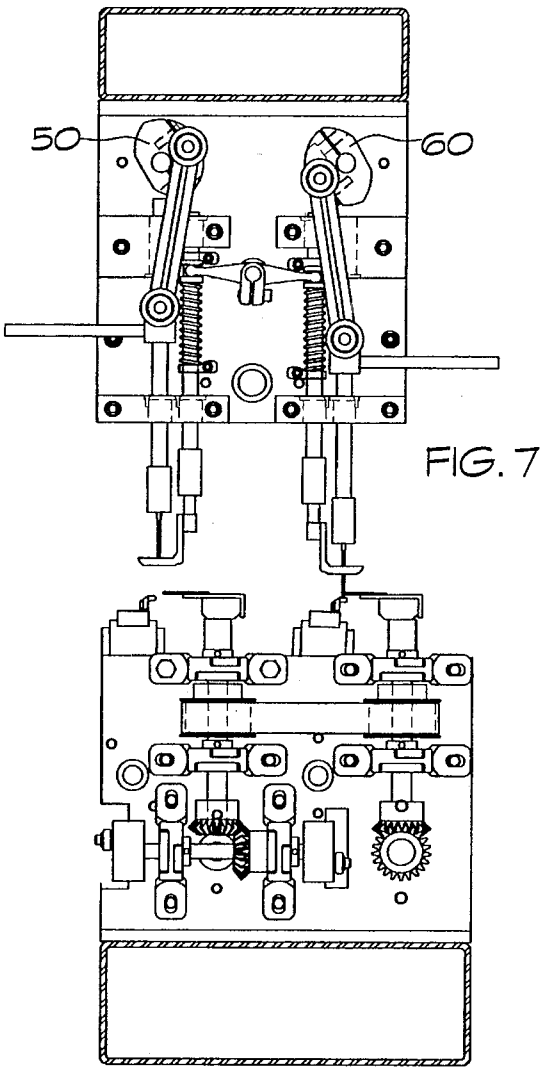

With reference to FIGS. 1–3, FIG. 1 shows a front view of the quilter 10 having three side by side upper sewing assemblies 30 and one lower sewing assembly 80. FIG. 2 shows the furthest right upper sewing assembly 30 and the portion of the lower sewing assembly 80 thereunder. FIG. 3 shows a right side view of the portion of FIG. 2. As was previously mentioned, the quilter could easily be designed to sew over a different length. Therefore, different numbers of upper assemblies from one up could be employed with a corresponding lower assembly. A motor, not shown, is used to drive an upper main shaft 26, which operates the needle bars and presser feet, and is also used to drive a lower main shaft 28, which operates the spreaders and loopers.

With reference to FIGS. 1–3 and 26, one upper assembly is explained. A frame 32 has upper main shaft 26 passing therethrough. Shaft 26 has a drive gear 34 thereon. Frame 32 supports a front needle shaft 36, having a drive gear 38 thereon, and also supports a rear needle shaft 40, having a drive gear 42 thereon; shafts 26/36, 26/40, and 36/40 being in a parallel alignment and gears 34, 38, and 42 being in a vertical plane. A drive belt 44 connects gears 34, 38, and 42. Therefore, as upper main shaft 26 is rotated, belt 44 causes shafts 36 and 40 to rotate. With the one belt configuration, shafts 36 and 40 rotate in the same direction.

Figure 27:
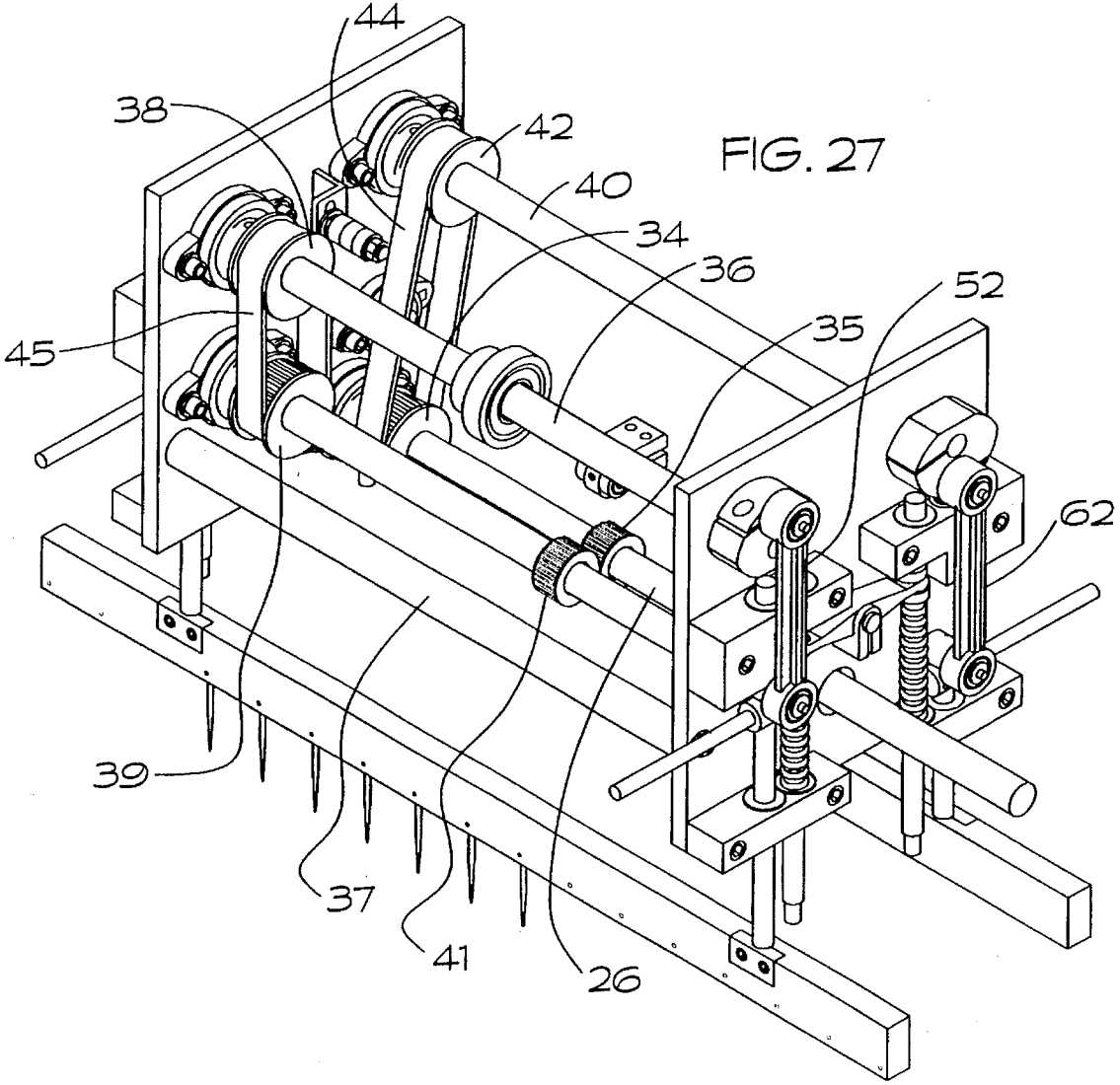
FIG. 27 shows a perspective view of a selected portion of an alternative upper sewing assembly, wherein the needle bar cranks rotate in opposite directions.
Figure 28:
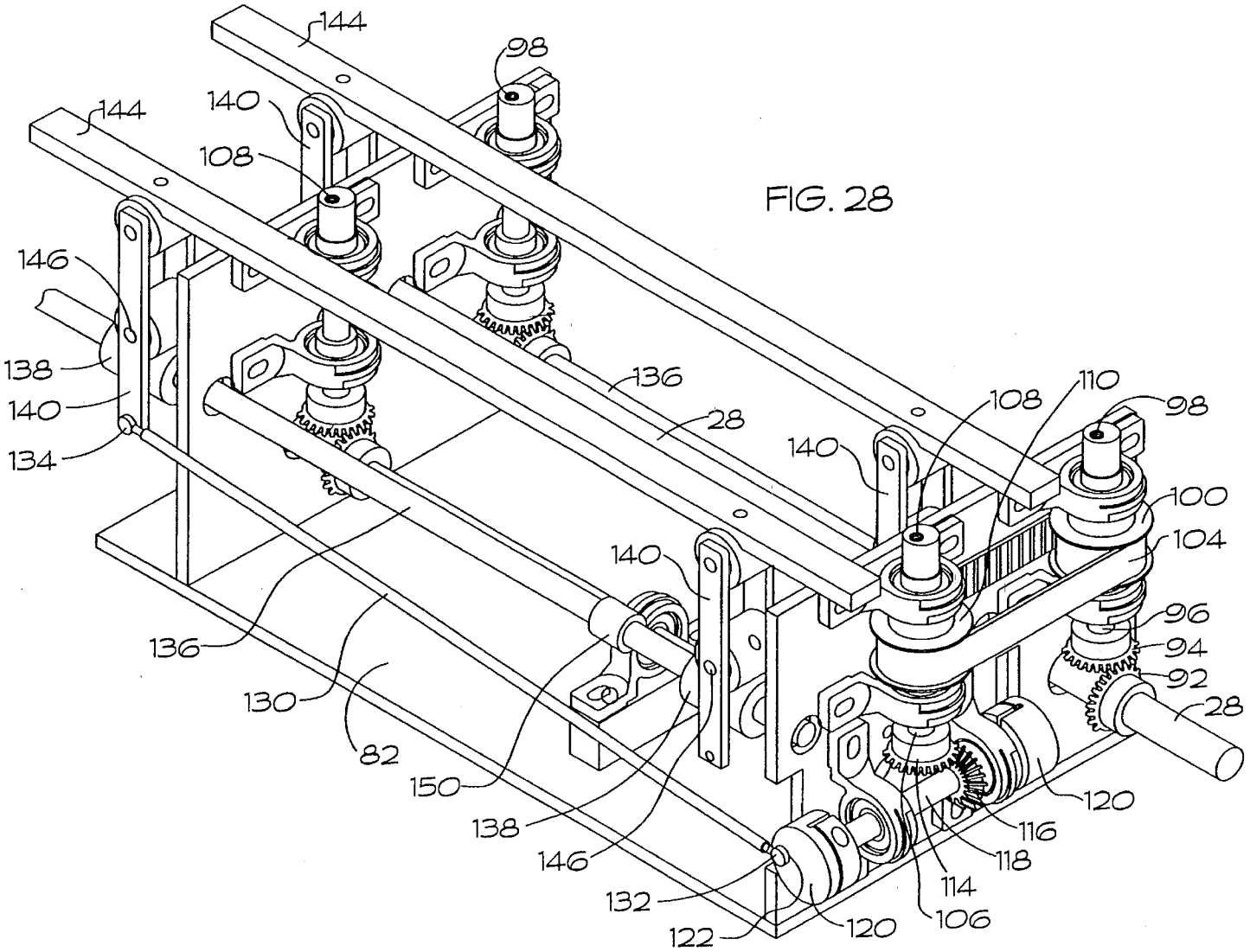
FIG. 28 shows a portion of the spreader/looper drive assembly.

FIG. 27 teaches an alternative configuration to cause shafts 36 and 40 to rotate in opposite directions. This configuration causes the quilter to be even "more balanced". This configuration employs an additional shaft 37, having a drive gear 39 thereon. Upper main shaft 26 has a gear 35 thereon and shaft 37 has a gear 41 thereon, gears 35 and 41 meshing. Belt 44 is connected between gear 34 and 42, so that shaft 40 rotates as in the example of FIG. 26. A additional belt 45 is connected between gears 39 and 38. This results in shaft 36 rotating in the opposite direction of shaft 40.

With reference back to FIGS. 1–3 and 26, the two ends of front needle shaft 36 have a front needle bar crank 50 connected thereto and the two ends of rear needle shaft 40 have a rear needle bar crank 60 connected thereto. Each front needle bar crank 50 has a front needle bar connector link 52 connected thereto, the connection being off-set from the axis of shaft 36. Each rear needle bar crank 60 has a rear needle bar connector link 62 connected thereto, the connection being off-set from the axis of shaft 40. Therefore, as shafts 36 and 40 rotate, the connected ends of links 52 and 62 move in a circle about the axes of the respective shafts 36 and 40. The other ends of links 52 and links 62 are connected to respective front needle bar shafts 54 and rear needle bar shafts 64. Shafts 54 and 64 are limited to vertical up and down movement, caused by the turning of shafts 36 and 40, the turning of cranks 50 and 60, and the movement of links 52 and 62, respectively.

Two front needle bar shafts 54 are connected to a front needle bar 56. Likewise, two rear needle bar shafts 64 are connected to a rear needle bar 66. Needle bars 56 and 66 can have needles 58 connected thereto at desired locations, determined by the pattern to be sewn.

Each needle 58 has a presser foot 79 which works in conjunction with the needle. Therefore, front needle bar 56 has a corresponding front presser bar 74 and rear needle bar 66 has a corresponding rear presser bar 78. Frame 32 supports a presser foot shaft 46, shaft 46 being individually parallel to shafts 26, 36, and 40. Presser foot rock eccentrics 48 are connected between shaft 36 and shaft 46. Eccentrics 4:3 cause shaft 46 to oscillate back and forth as shaft 36 rotates. The two ends of presser foot shaft 46 have a presser bar rock frame 70 connected thereto. A front end of each presser bar rock frame 70 is connected to a front presser bar shaft 72 and a rear end of each presser bar rock frame 70 is connected to a rear presser bar shaft 76. Two front presser bar shafts 72 are connected to a front presser bar 74. Likewise, two rear presser bar shafts 76 are connected to a rear presser bar 78. Presser bars 74 and 78 can have presser feet 79 connected thereto at desired locations, determined by the location of needles 58.

With reference to FIGS. 1–3 and 28, the lower sewing assembly 80 is explained. Assembly 80 includes a frame 82 having supports 84 for lower main shaft 28. As was mentioned earlier, assembly 80 moves the loopers and spreaders. The assembly which drives the spreader bars 112 and 102 and drives looper bars 144 left and right is identified by the numeral 90. The assembly 90 includes a gear 92 on lower main shaft 28. Gear 92 meshes with a transverse gear 94 connected to vertical rear spreader bar shaft 96. The top of shaft 96 contains an off-set bore 98 therein. Shaft 96 has a gear 100 thereon.

A front spreader bar shaft 106, with a top off-set bore 108 therein, has a gear 110 thereon. A timing belt 104 connects gears 100 and 110 to cause shafts 96 and 106 to simultaneously rotate in the same direction. The lower end of shaft 106 has a gear 114 thereon. A transverse gear 116, having a shaft 118 therethrough, meshes with gear 114. Shaft 118 has a looper crank 120 at each end, one crank for front loopers and one crank for rear loopers. Each looper crank 120 has an off-set bore 122 therein.

With particular reference to FIG. 1, it is seen that lower sewing assembly 80 has an assembly 90 at each end. A similar assembly 91 is toward the center portion of assembly 80. Assembly 91 includes the portions of assembly 90 which drive the spreader shafts, those being gears 92/94, shafts 96 and 106 with respective gears 100 and 110 thereon, with timing belt 104 therebetween. Between center assembly 91 and each end assembly 90 is an assembly 93. Each assembly 93 contains gears 92/94 and a shaft 96. No timing belt 104 is employed with assemblies 93.

FIGS. 1–3 show a front spreader bar 112 is connected into bores 108 of shafts 106. Likewise, rear spreader bar 102 is connected into bores 98 of shafts 96. The rotation of shafts 96/106 with off-set bores 98/108 causes respective bars 102/112 and spreaders 113 to rotate in a circular pattern.

For front looper bar 144, FIG. 1 shows five looper couplings 138 on a looper rock shaft 136. A looper pivot 140 is connected to each coupling, 146 identifying the pivot point. Front looper bar 144 is connected to the top of the five looper pivots 140. Looper drive bars 130 are connected to off-set bores 122 in looper cranks 120, identified as location 132, at the two end assemblies 90. The right looper drive bar 130 is connected to the base of the second looper pivot 140 from the right, identified as location 134. The left looper drive bar 130 is connected to the base of the second looper pivot 140 from the left, also identified as location 134. The connections at locations 132 and 134 employ rod end bearings to alleviate stress on bars 130 when looper rock shaft 136 is rocked back and forth by eccentrics 150 connected between shafts 28 and 136.

As shaft 28 rotates, the connectivity through gears 92/94, shafts 96/106 via gears 100/110 and belt 104., gears 114/116, shaft 118, looper crank 120, looper drive bar 130, to looper pivot 140 causes front looper bar 144 and loopers 145 thereon to move left/right. Also, as shaft 28 rotates, eccentrics 150 connected between shafts 28/136 causes shaft 136 to oscillate back and forth. This causes front looper bar 144 and loopers 145 to move front/back. With this combined movement, loopers 145 travel in an oblong pattern.

The rear looper bar 144, with couplings 138, looper pivots 140, looper rock shaft 136, and eccentrics 150 are similarly arranged. FIG. 3 shows the end of rear looper rock shaft 136 and the end of rear looper drive bar 130 connected to rear looper crank 120.

Figure 6:
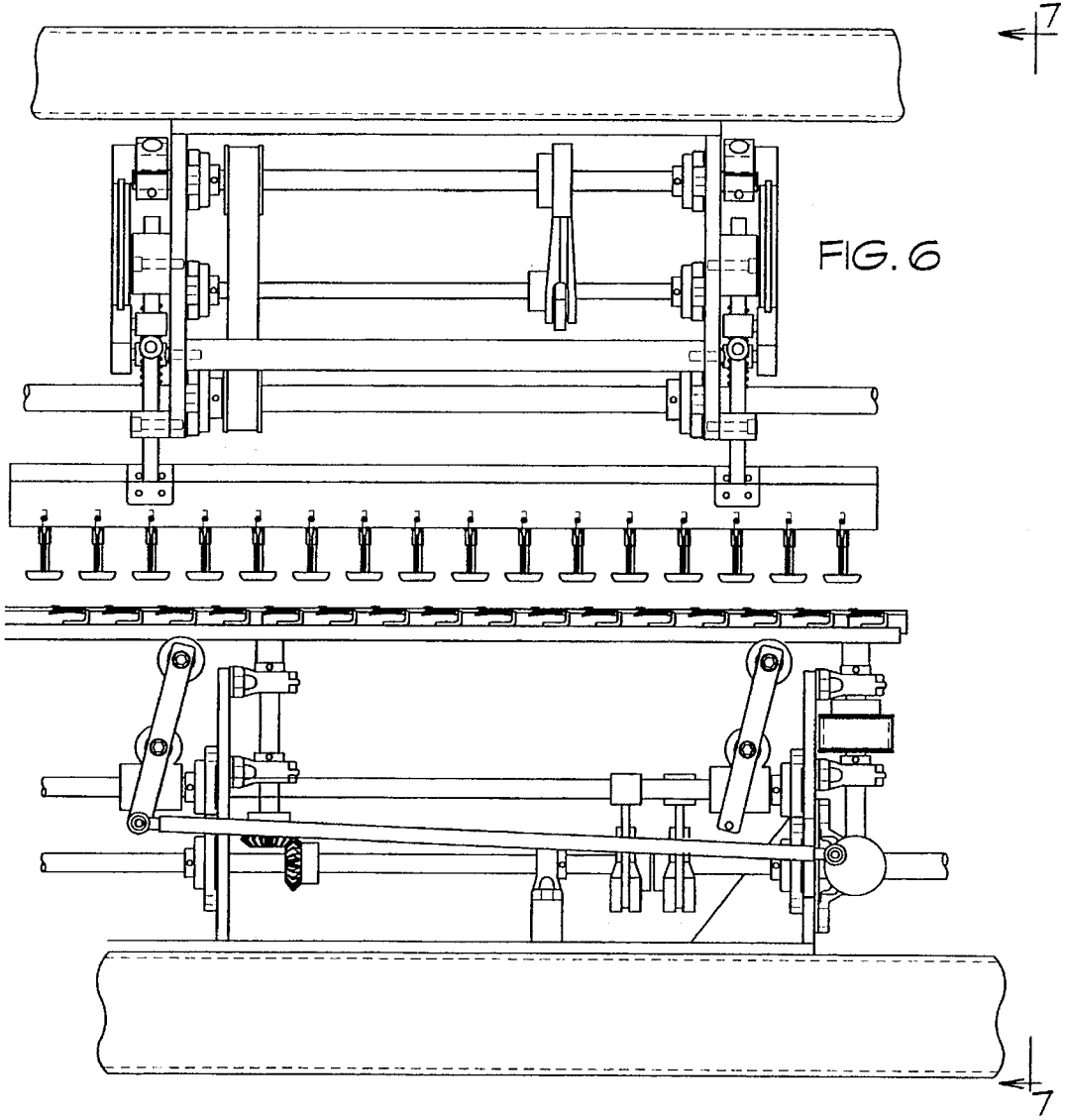
Figure 9:
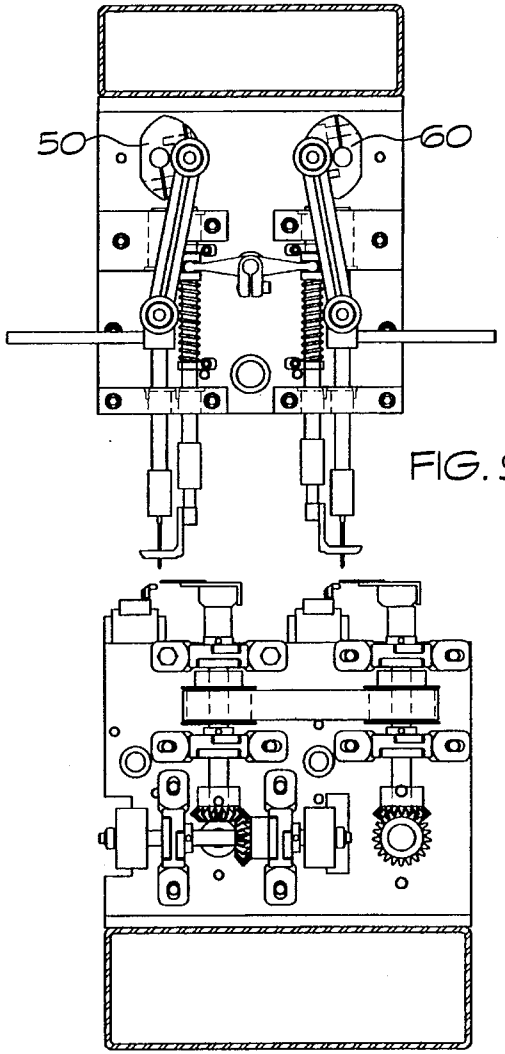
Figure 8:
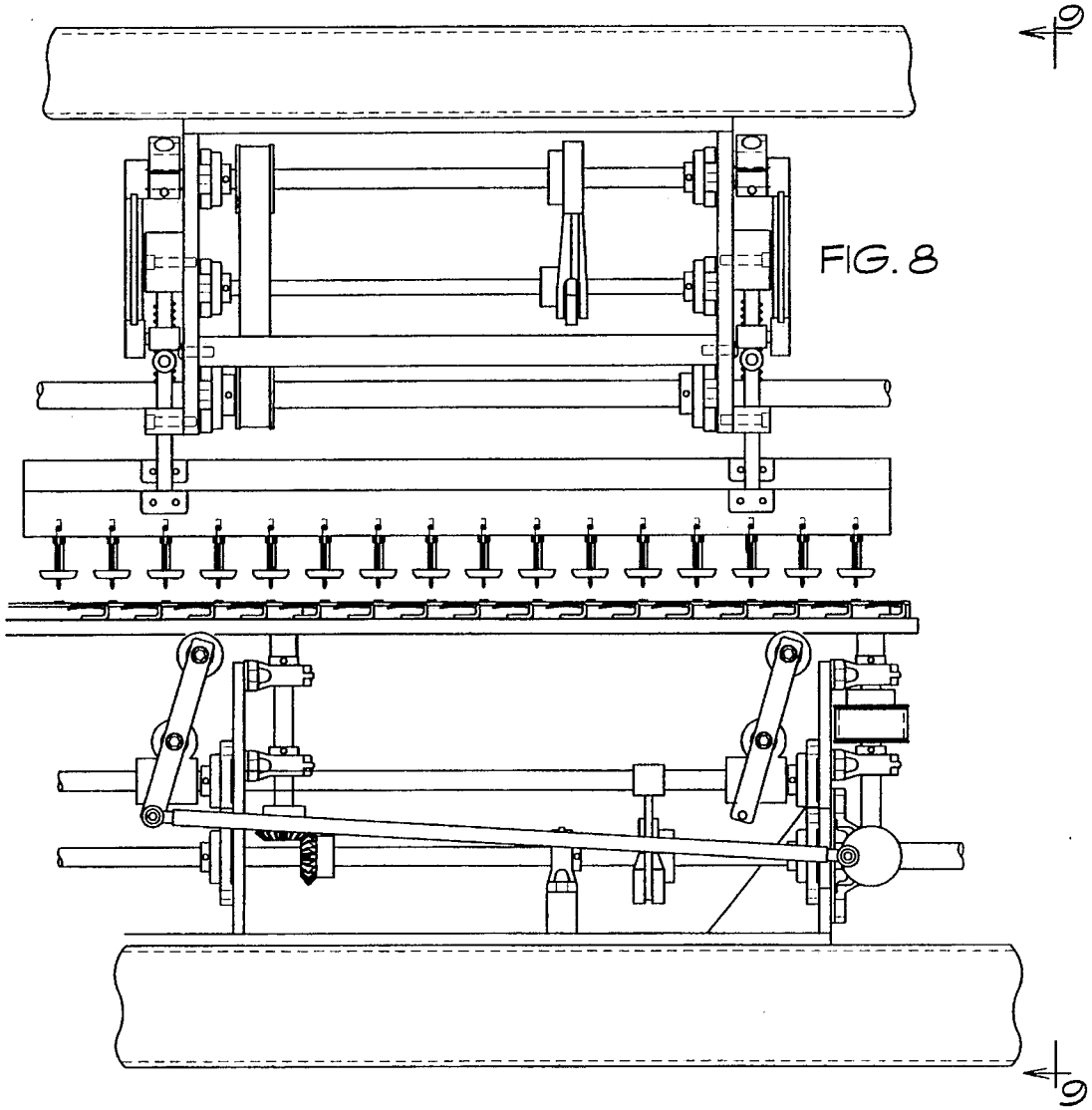
Figure 11:
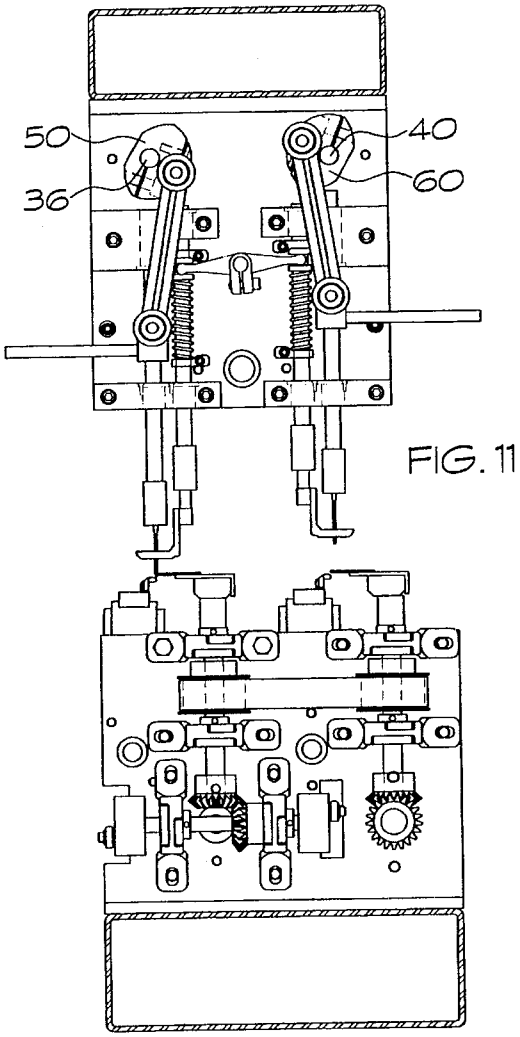
Figure 10:
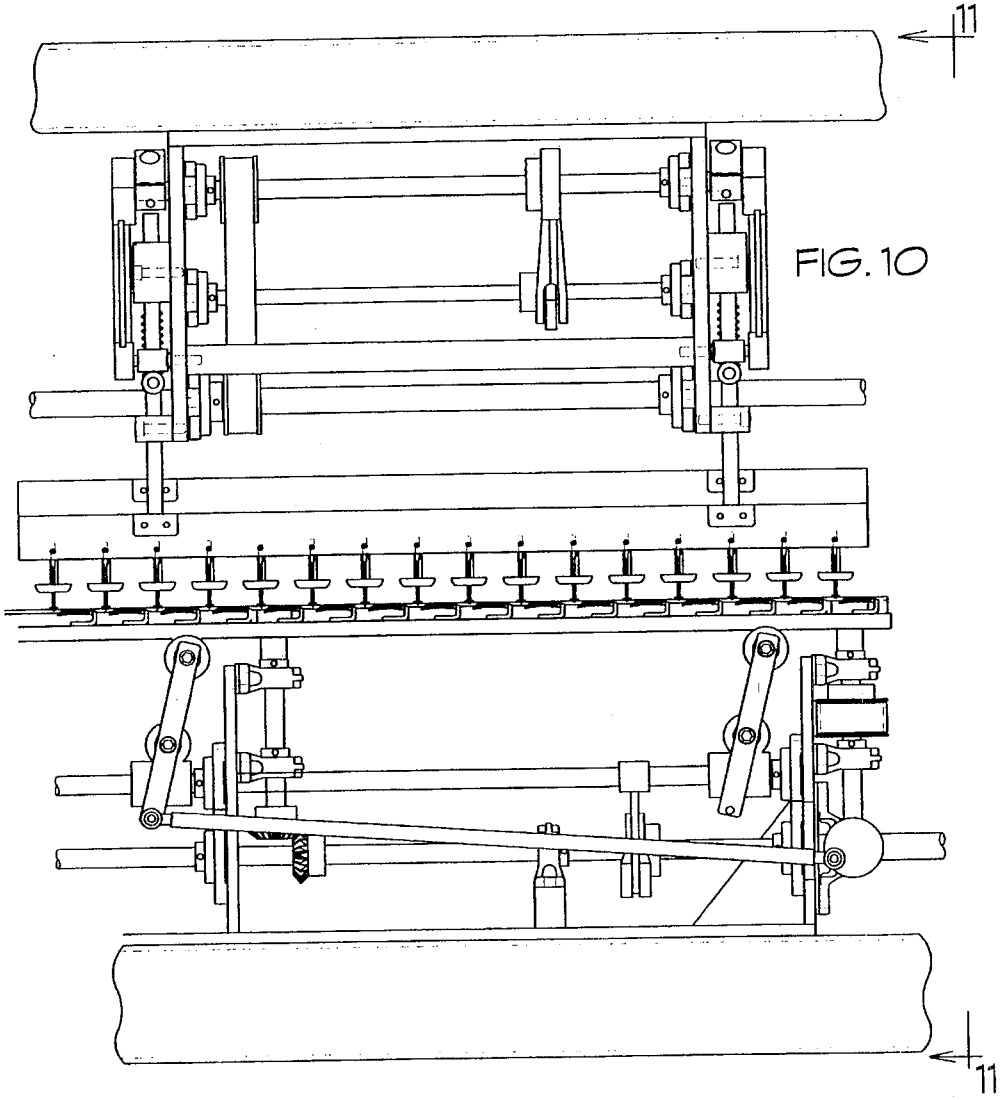
Figure 13:
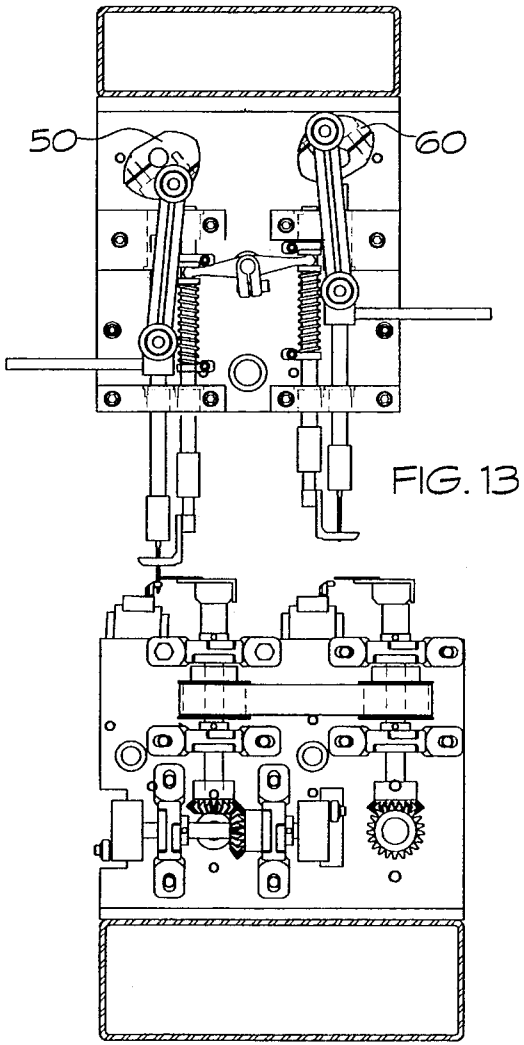
Figure 12:
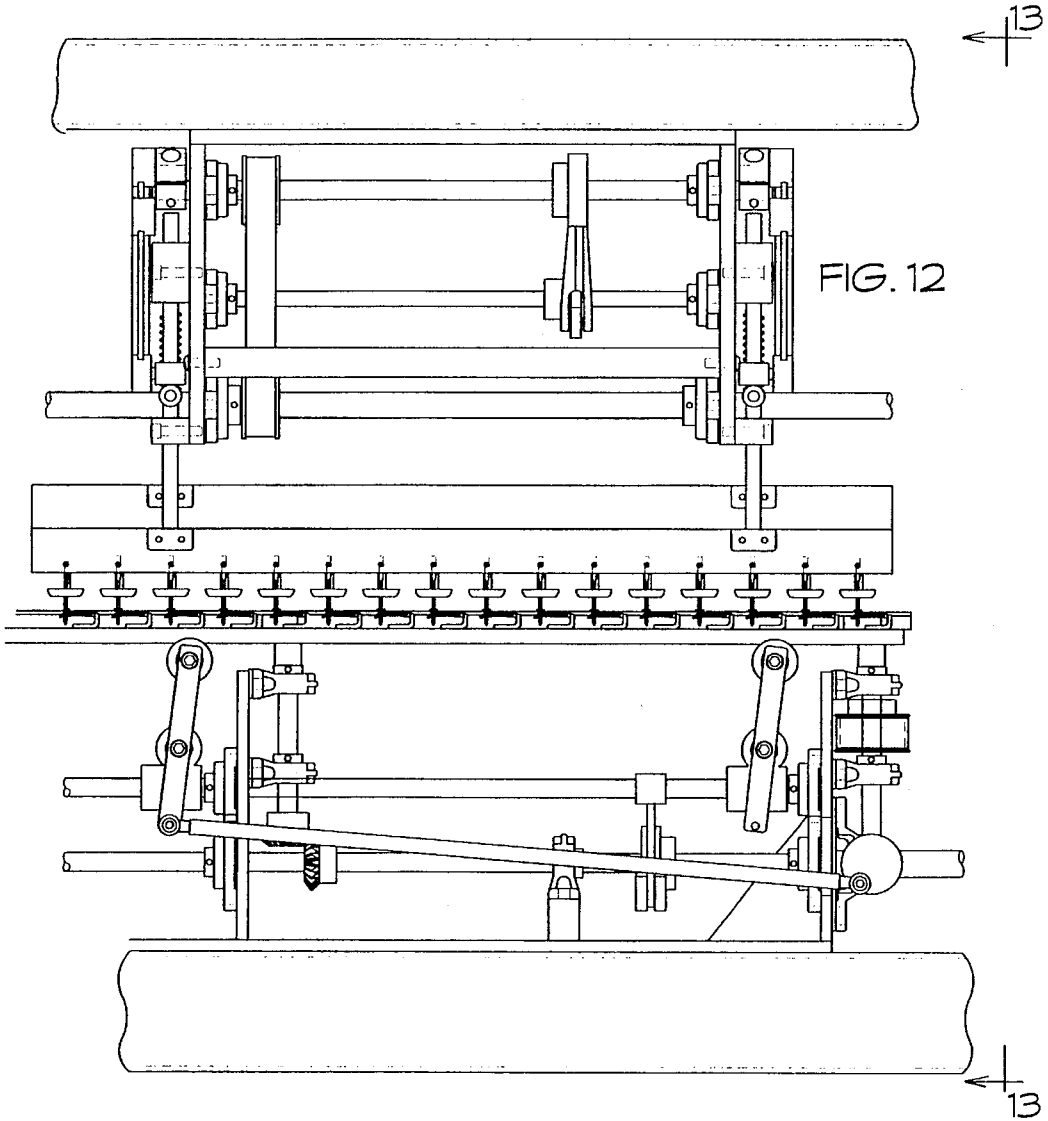
Figure 15:
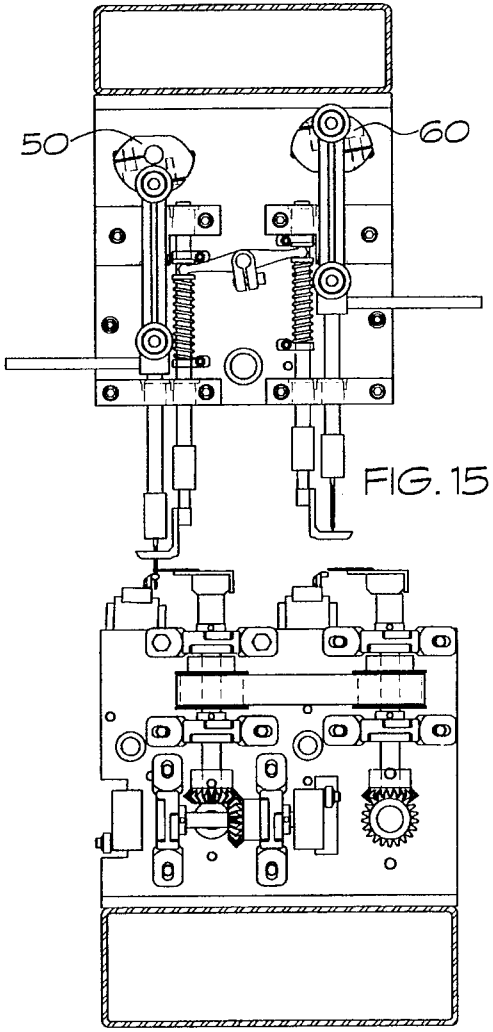
Figure 14:
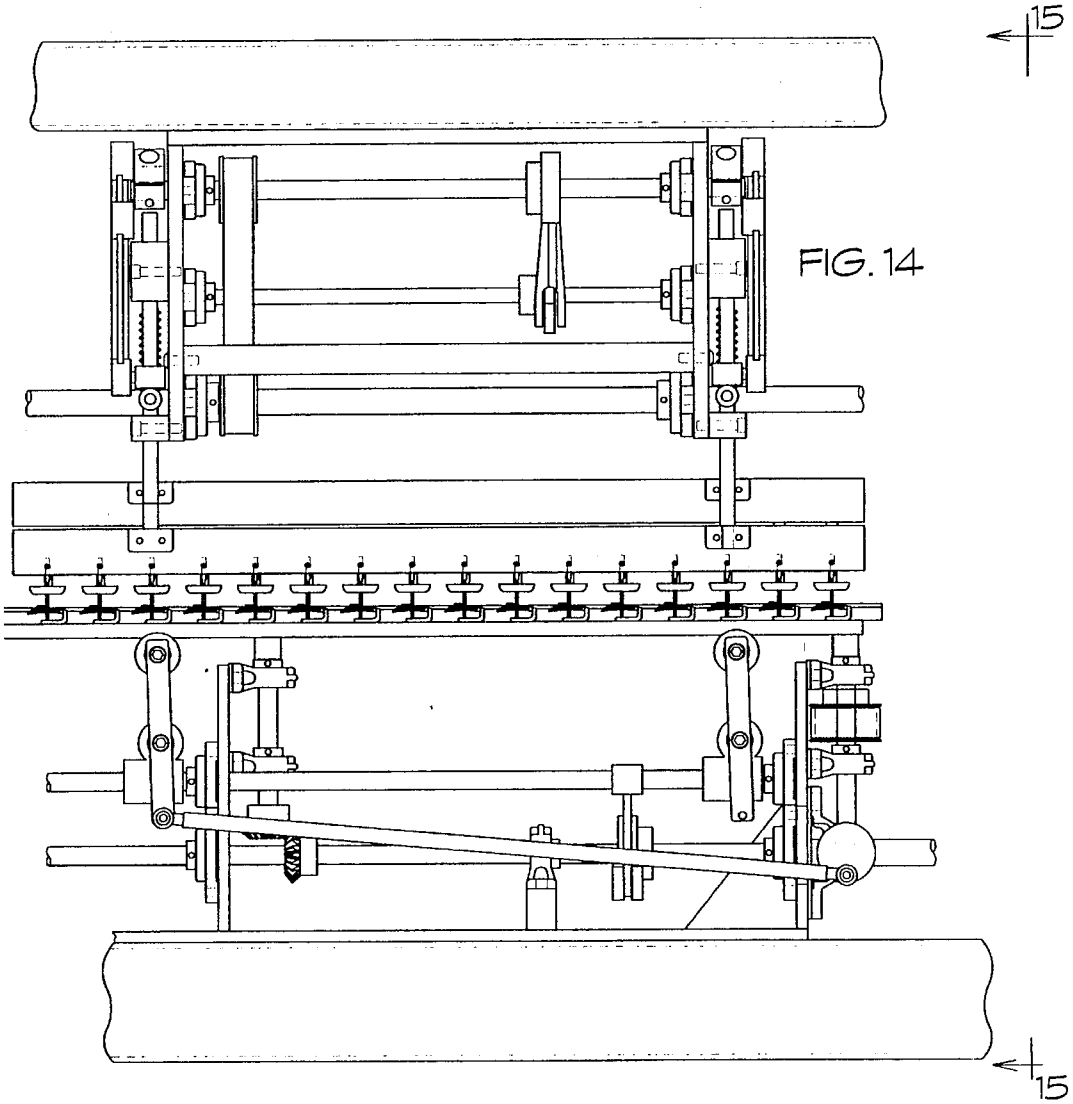
Figure 17:
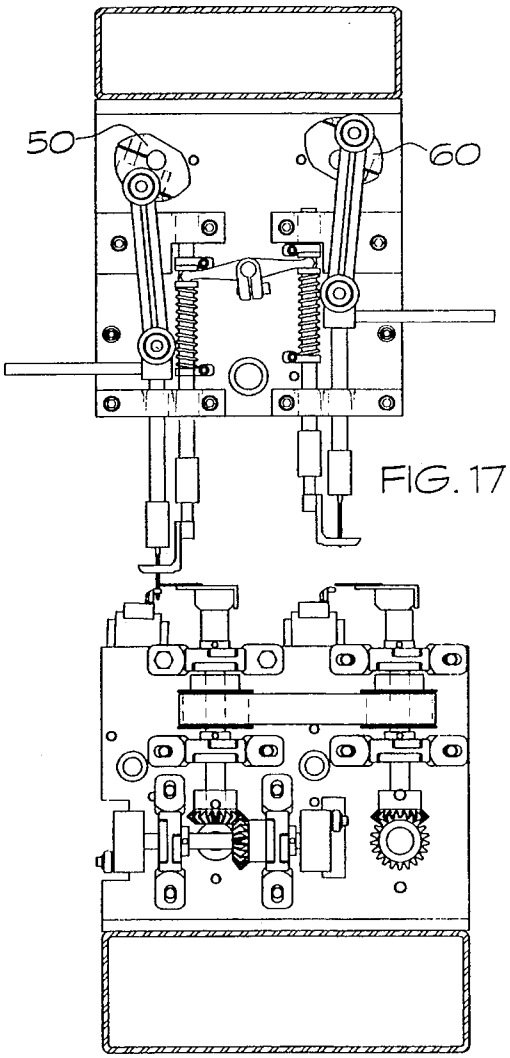
Figure 16:
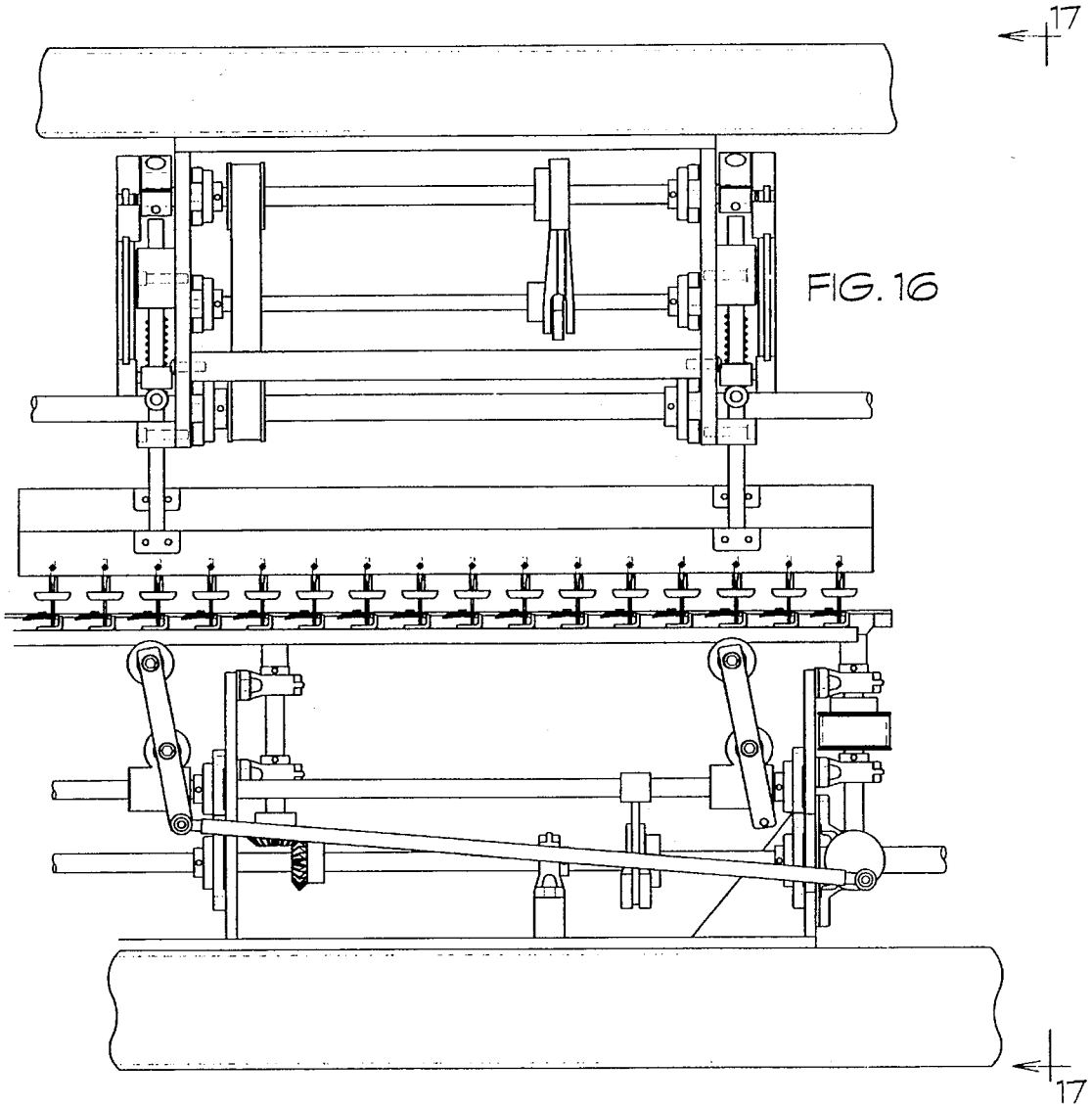
Figure 19:
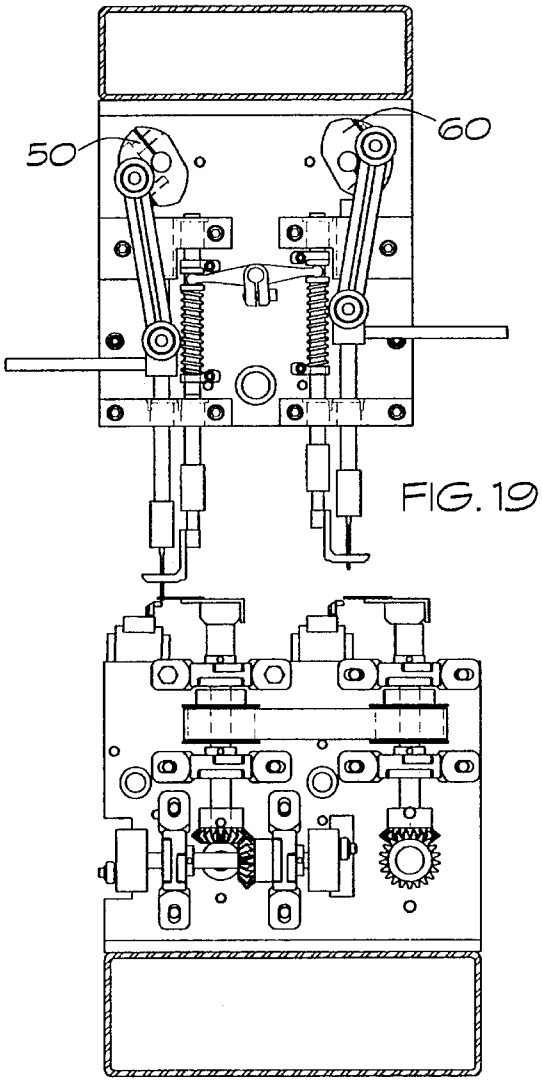
Figure 18:
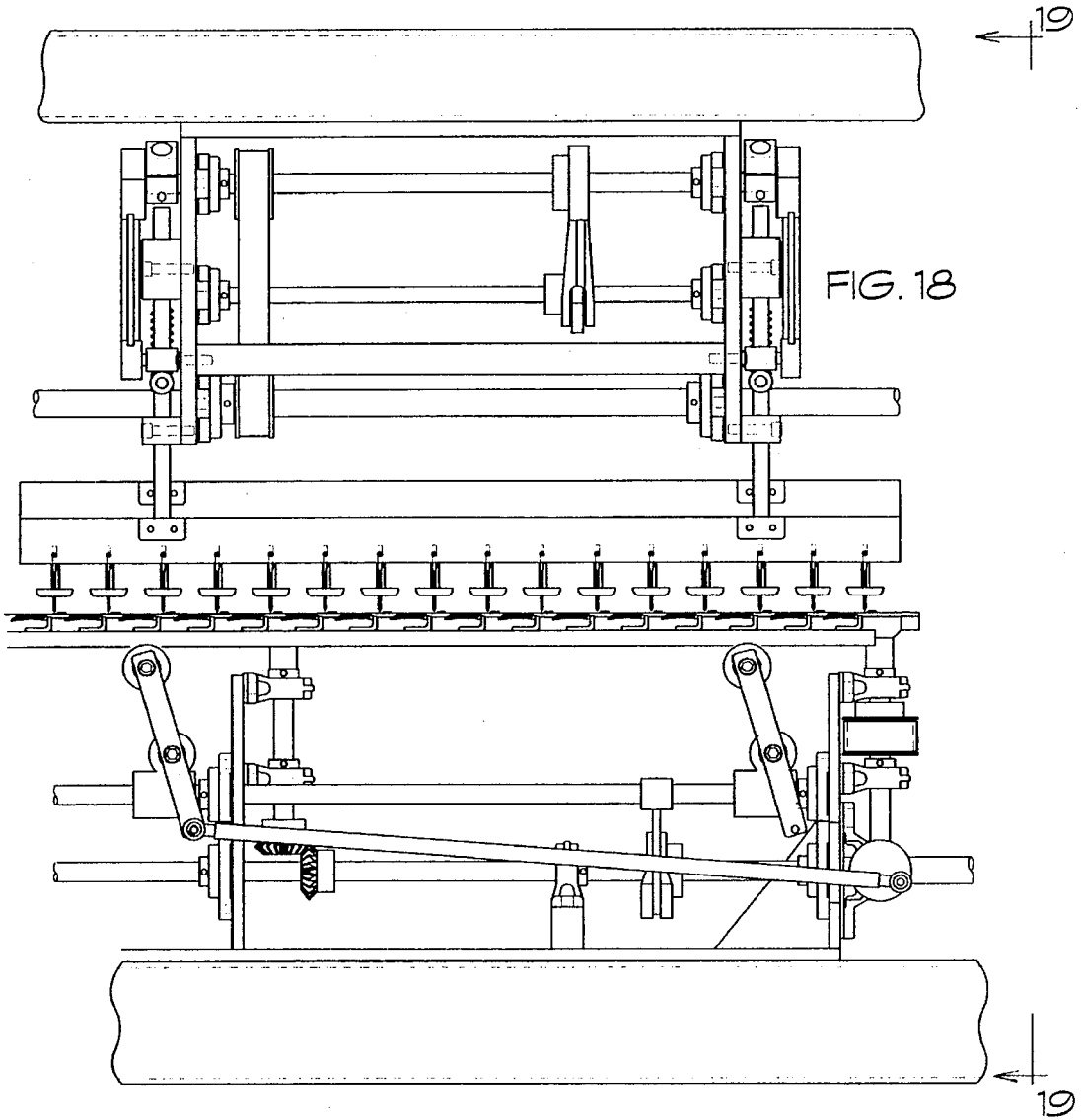
Figure 21:
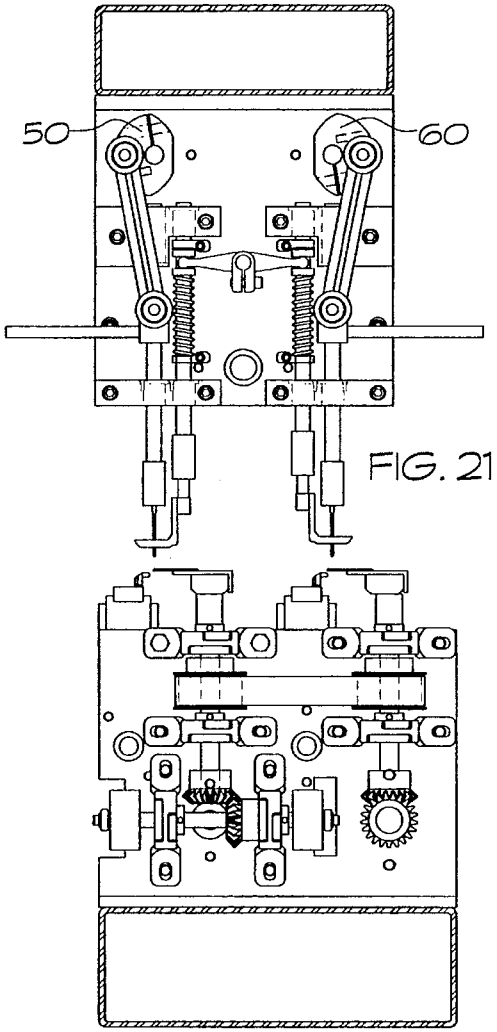
Figure 20:
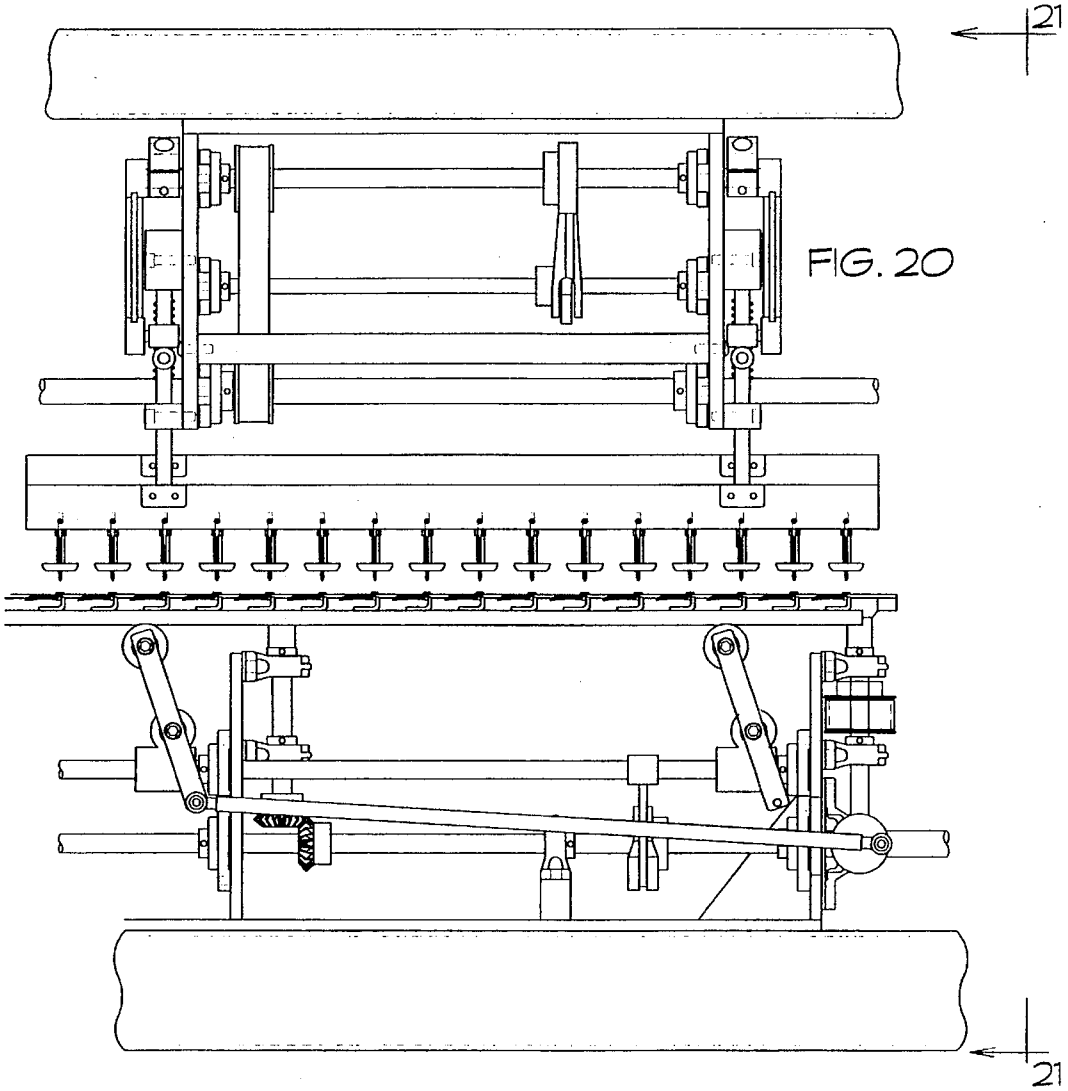
Figure 23:
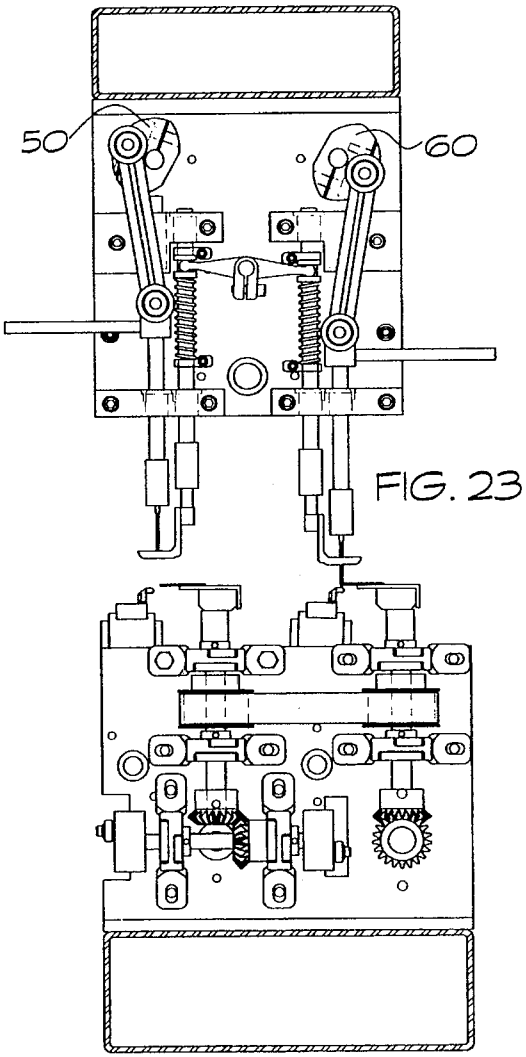
Figure 22:
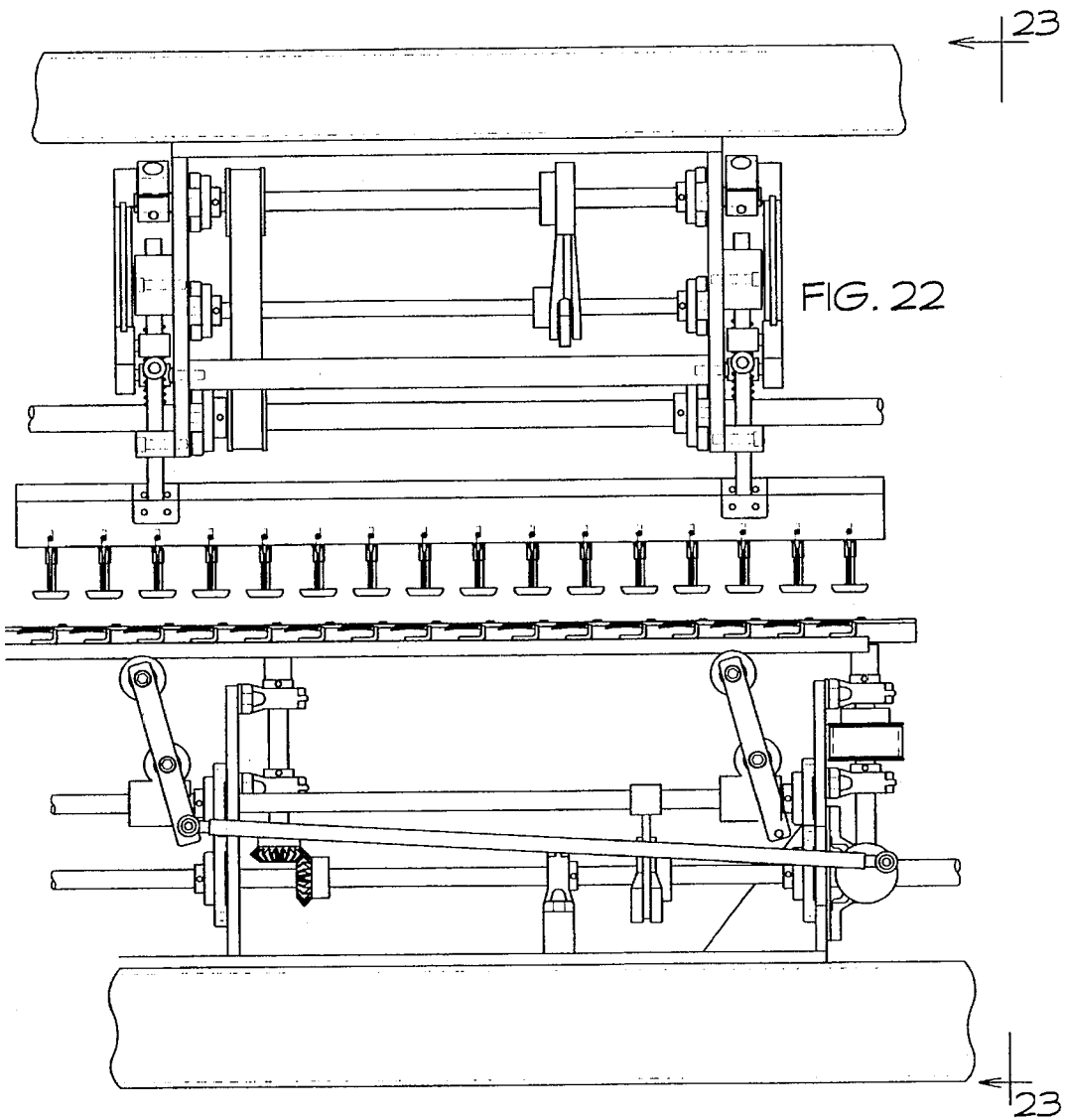
Figure 25:
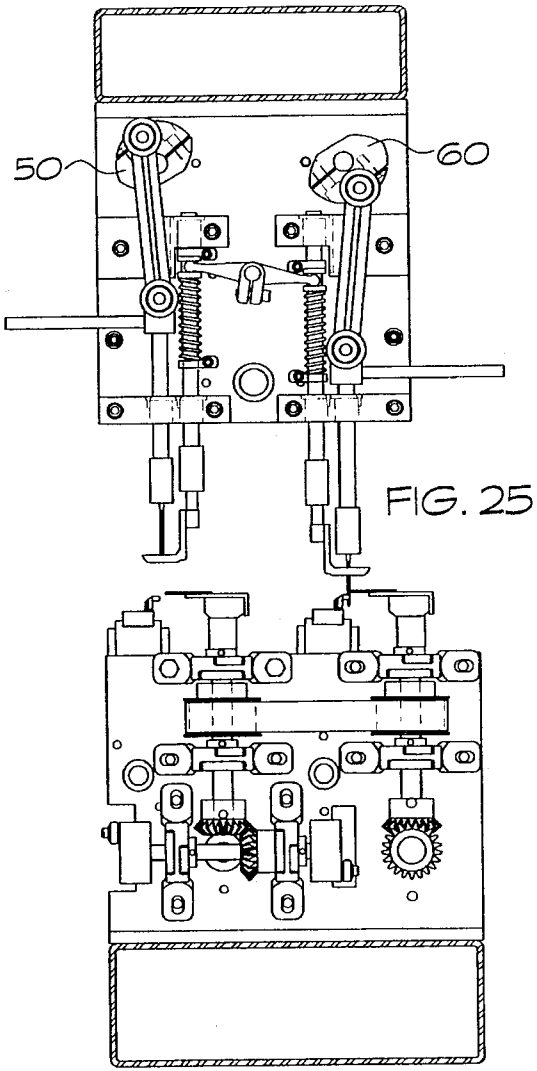
Figure 24:
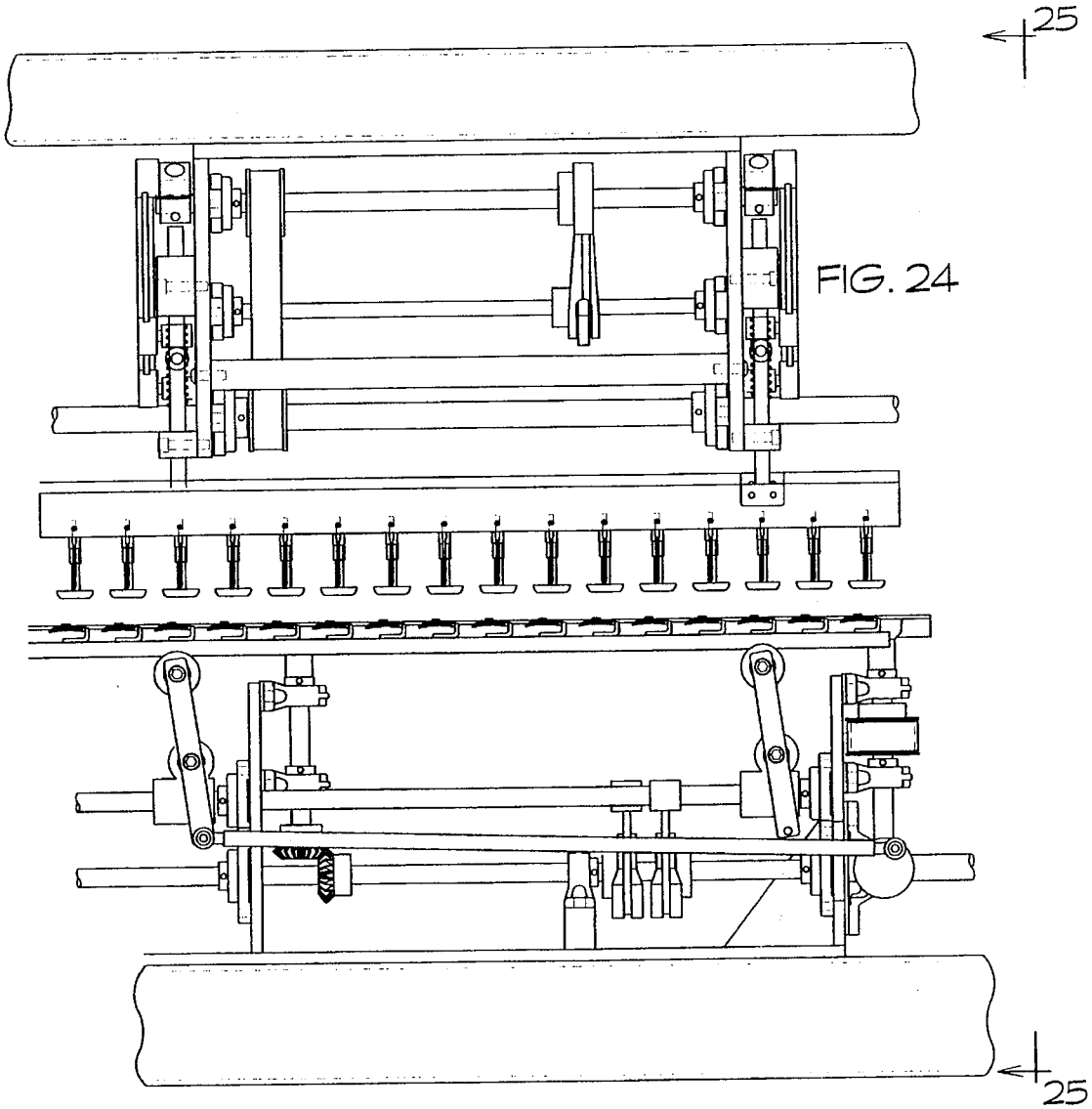
Figure 26:
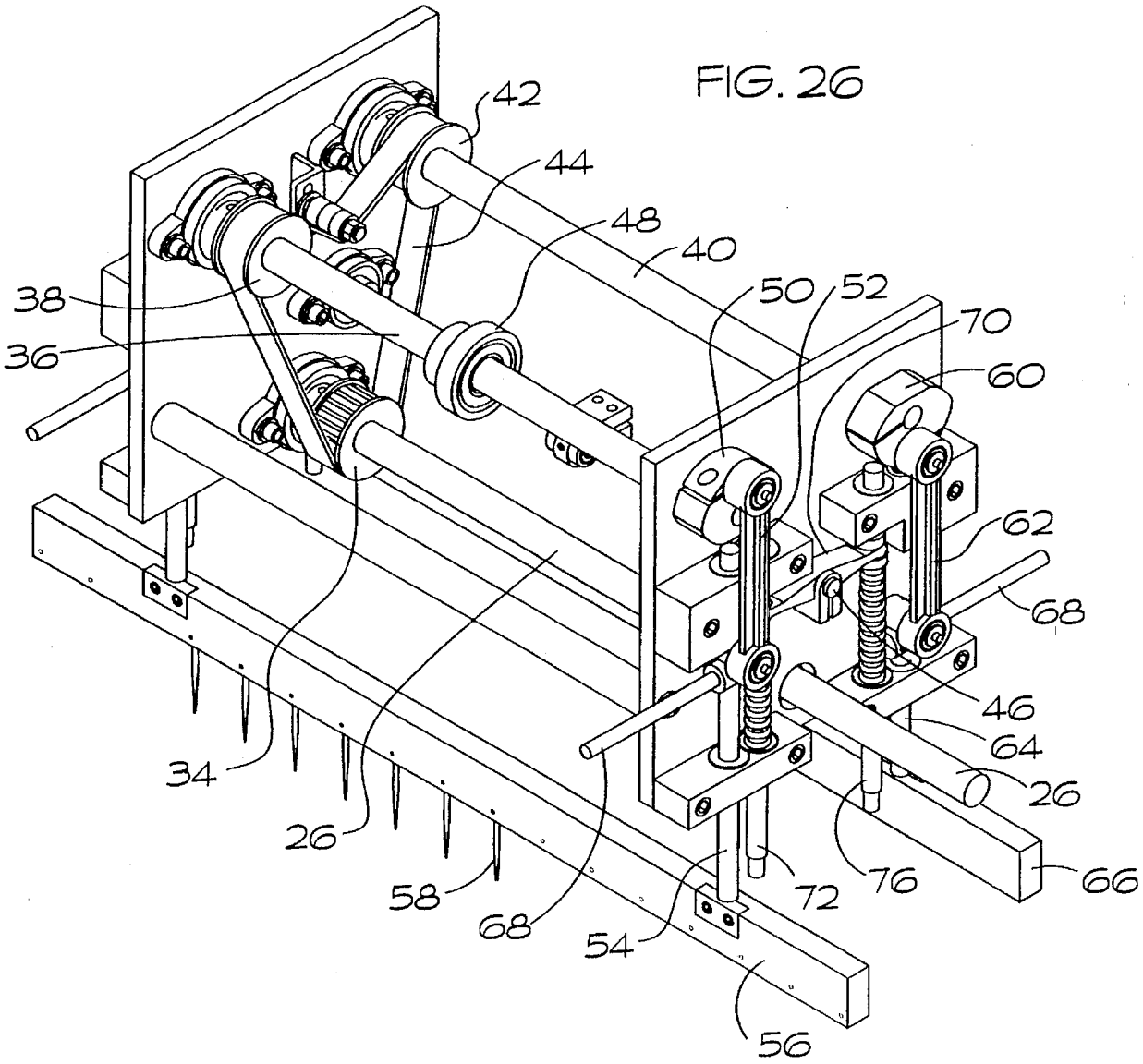
FIG. 26 shows a perspective view of a selected portion of an upper sewing assembly, wherein the needle bar cranks rotate in the same direction.

FIGS. 2/3 show front needle bar 56 and front presser bar 74 in their most downward position and rear needle bar 66 and rear presser bar 78 in their most upward position. With reference to FIGS. 2–25, front needle bar crank 50 and rear needle bar crank 60 are shown rotating in the same clockwise direction (when viewed from the odd numbered drawings). This is the configuration explained with FIG. 26 above. Cranks 50/60 could also rotate in opposite directions, as was explained with reference to FIG. 27 above. FIGS. 2/3, 4/5, 6/7, 8/9, 10/11, 12/13, 14/15, 16/17, 18/19, 20/21, 22/23, and 24/25 show the relative movements of the sewing components of the quilter 10 at respective thirty degree advancements of cranks 50/60. For example, cranks 50/60 of FIGS. 6/7 have rotated sixty degrees clockwise from their position in FIGS. 2/3 and cranks 50/60 of FIGS. 8/9 have rotated ninety degrees clockwise from their position of FIGS. 2/3.

Figure 29:
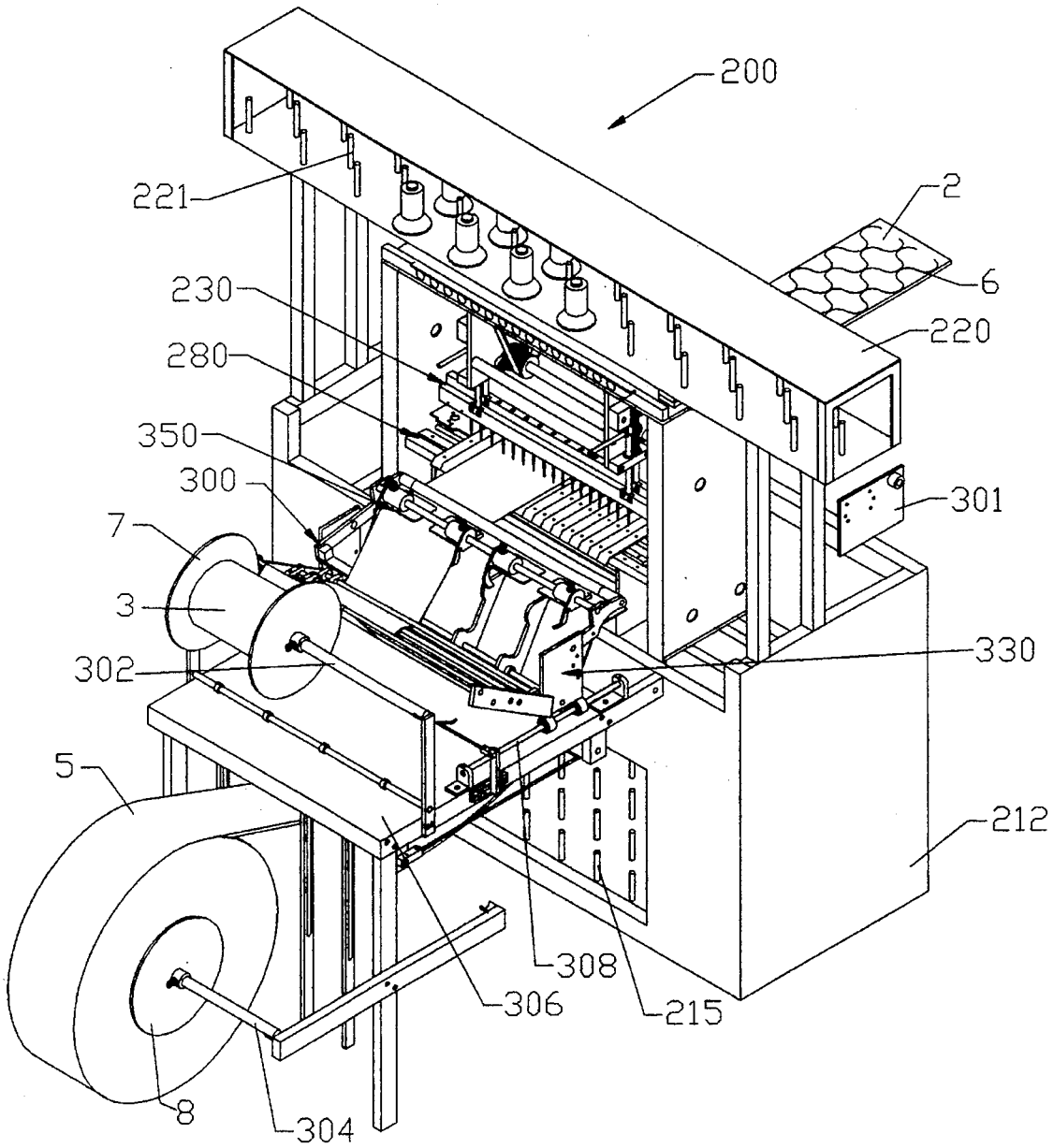
FIG. 29 shows a perspective view of the multi-needle border machine of the present invention.
Figure 30:
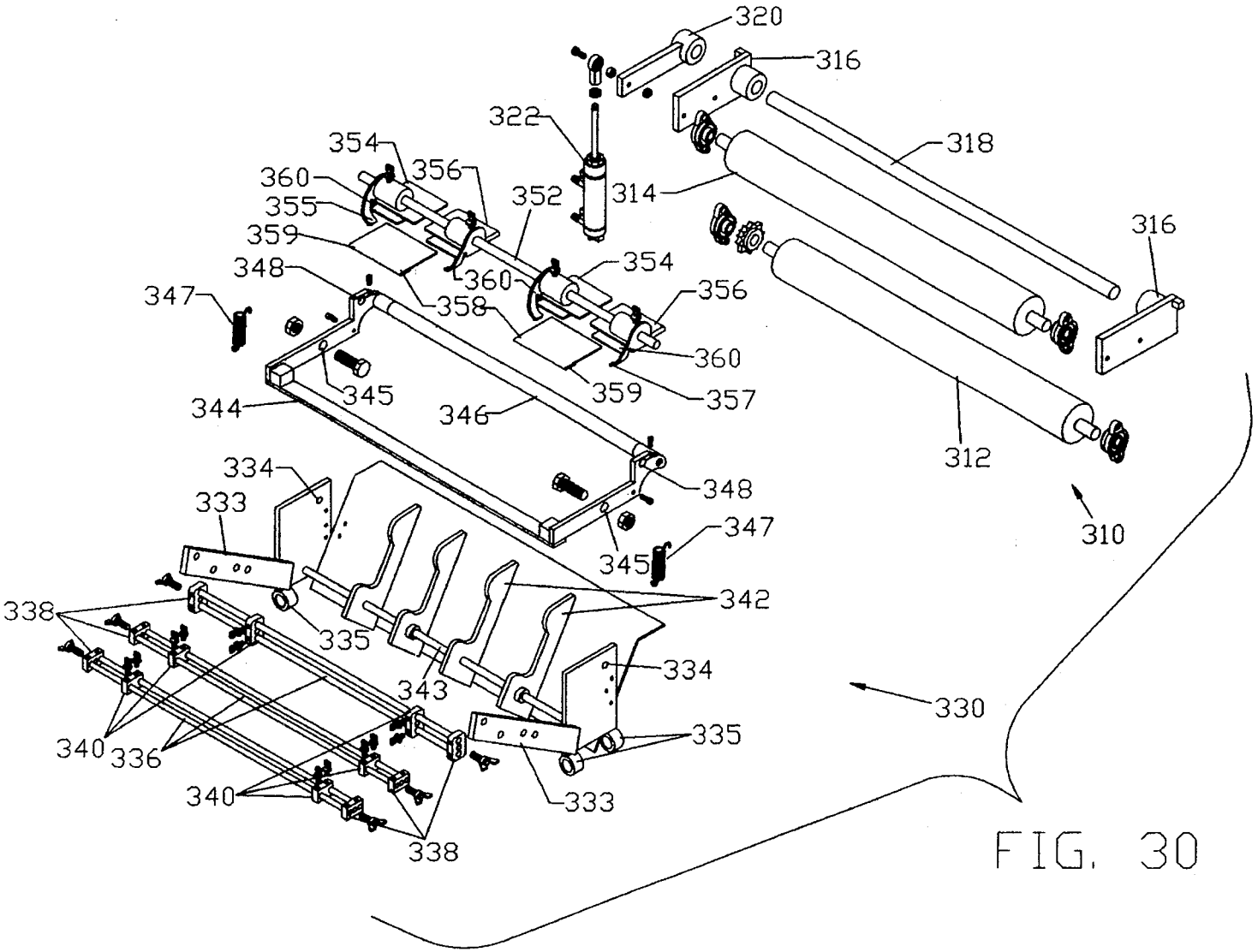
FIG. 30 shows an exploded view of the material feed and folding assembly of the multi-needle border machine of FIG. 29.
Figure 31:
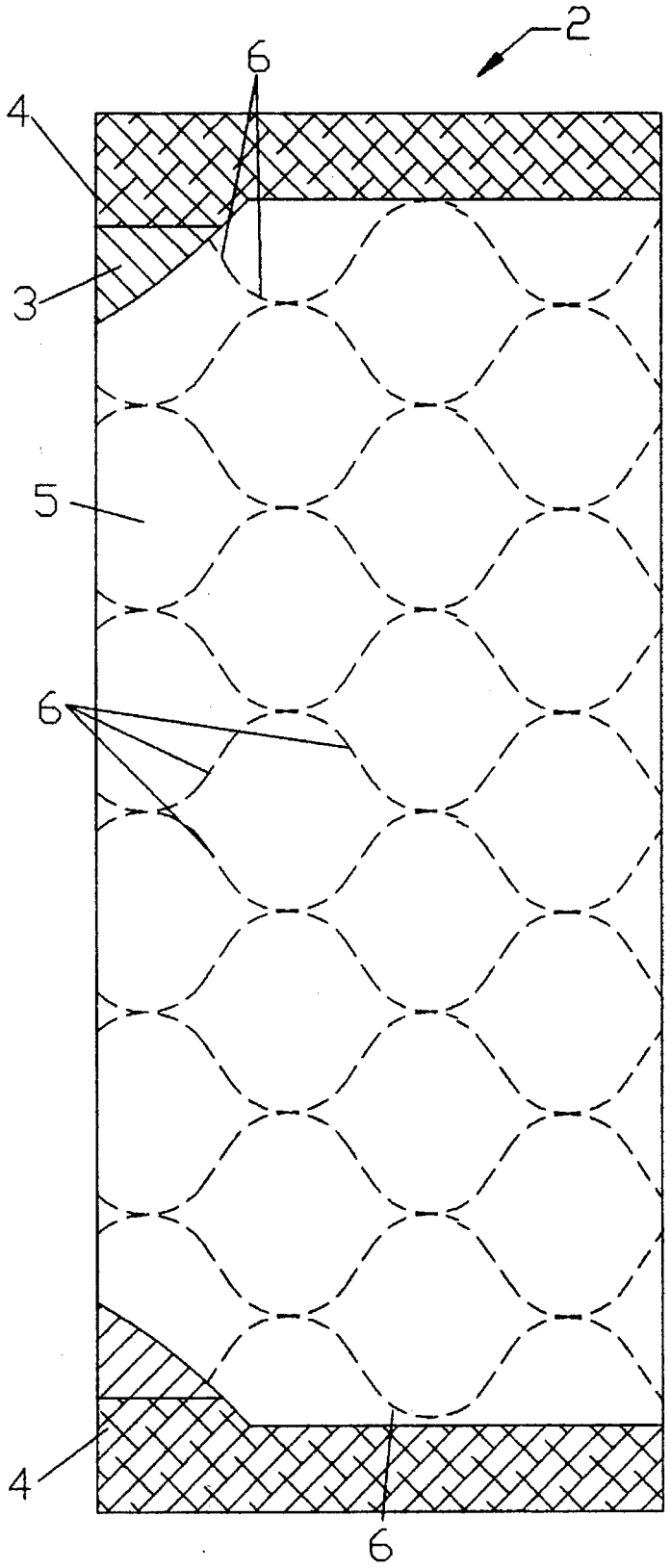
FIG. 31 shows a bottom view of a border piece showing a sample sewing pattern; and, FIG. 32 shows the multi-needle border machine of FIG. 29 having a plurality of first and second materials thereon.

FIGS. 29 and 30 are directed to a multi-needle border machine 200 which can sew one or two pieces of border 2. The back of a piece of border 2 having a selected pattern 6 is shown in FIG. 31, the top being shown in FIG. 29. Border 2 comprises ticking 3 and filler 5. Machine 200 incorporates a folder assembly 350 which folds under the edges of ticking 3, identified as the numeral 4. In FIG. 31, two "triangular" portions of filler 5 have been removed to show folded edges 4. It is seen that the pattern 6 sewn into border 2 extends into the folded areas 4. This eliminates the need for later serging of the unfinished ticking/filler produced by prior art machines. Machine 200 incorporates the sewing assembly teachings of the quilter 10. Likewise, quilter 10 can be easily modified to sew one or more comparatively narrow width border pieces instead of quilting a comparatively wide top piece using the teachings of machine 200.

With reference to FIGS. 29 and 30, border machine 200 includes a base frame 212 having lower thread bars 215. A sewing frame 220 includes upper thread spool bars 221. Machine 200 includes an upper sewing assembly 230 and a lower sewing assembly 280. Upper assembly 230 is like an upper sewing assembly 30 of quilter 10 and lower assembly 280 is like lower sewing assembly 80, the sewing operation of assemblies 230 and 280 being as was described with the discussion of quilter 10.

Border machine 200 includes a material feed and folding assembly 300, having a pull roller assembly 310, a material guide and tensioning assembly 330, and a folder assembly 350. Assembly 300 includes a ticking spool rod assembly 302 having a roll of ticking material 3 on spool 7 thereon. Assembly 300 includes a filler spool rod assembly 304 having a roll of filler 5 on spool 8 thereon. A material guide assembly support 306 extends forward of base frame 212 and supports assemblies 302, 304, and 330. Assembly 330 is received on mounting bars 308. This permits assembly 330 to be easily moved away from base frame 212 to permit easier threading.

The ticking 3/filler 5 is pulled through the machine "downstream" of the sewing area using pull roller assembly 310. One of the pull roller assembly 310 mounting plates 301 is seen in FIG. 29, plate 301 being attached to base frame 212. For successful sewing of the border pattern and holding the fold 4 until sewing, the ticking 3/filler 5 is kept under tension "upstream" of the sewing area using material guide tensioning assembly 330.

Pull roller assembly 310 includes a bottom roller 312, top roller 314, roller pivot arms 316, roller pivot shaft 318, roller lifting arm 320 and roller lifting cylinder 322. Cylinder 322 is used to set the desired tension between rollers 312 and 314 for pulling border 2 therebetween.

Material guide tensioning assembly 330 includes a material guide sliding assembly 332 having tension bar mounting area 333 for receiving the mounting blocks 338 of material tension bars 336, holding bracket mounting area 334 for pivotal attachment of material holding bracket 344 at mounting point 345, slide connectors 335 for receipt by bars 308, a plurality of adjustable filler guide brackets 342 having supporting shaft 343. Tension bars 336 include material guides 340 thereon. FIG. 29 demonstrates how ticking 3 snakes through tension bars 336. As rollers 312 and 314 pull on the ticking 3/filler 5, the snaking of ticking 3 through tension bars 336 causes ticking 3 to be placed under tension between rollers 312/314 and bars 336. Brackets 342 guide filler 5 to align with ticking 3. Naturally, ticking 3 and filler 5 are cut for desired widths. As these widths can change for various borders, guides 340 and 342 are adjustable.

Material holding bracket 344 includes a material holding roller 346 and mounting area 348 for receiving the shaft 352 of folder assembly 350. Springs 347 connect between holding bracket 344 and area 334 to pull roller 346 downward onto folded ticking 3 and filler 5. For each border to be sewn, shaft 352 has a left folder 354 and a right folder 356. Left folder 354 has a inward lip 355 and right folder 356 has an inward lip 357, cooperating lips 355 and 357 bending toward each other. Folders 354/356 have a channel 360, of a general "C" shape, through which the folded ticking 3 passes. To prevent ticking 3 from sagging, each pair of folders 354/356 has a material guide 358 therebetween. Guide 358 has a downturned lip 359 which is received by respective channels 360. Folders 354/356 are adjustable along shaft 352 to accommodate various width ticking 3. Lips 355/357 cause the edges of ticking 3 passing thereby to fold under to create folded edges 4. Holding roller 346 just downstream of folders 354/356, along with pull rollers 312/314 and tensioning bars 336 cause folded edges 4 to remain in ticking 3 until the desired pattern is sewn therein. Because the sewn pattern periodically sews through the two layers of ticking 3 creating folded edges 4, sewn border 2 has a finished edge which requires no additional finishing before use by the operator of the tape edge machine.

Opposed rotating rollers 312/314 comprise pulling means and are located at a downstream position from the upper and lower sewing assemblies 230/280, the sewn border piece 2 being pulled therebetween; where tensioning means comprises the plurality of parallel tensioning bars 336 located at an upstream position from the upper and lower sewing assemblies 230/280, the first material 3 and the tensioning bars 336 being in a snaking relationship; and where folding means comprises the pair of opposed folders 354/356 having a first material guide 358 therebetween, the opposed folders 354/356 having facing lips 355/357, the lips 355/357 causing the opposed edges 4 of the first material 3 to fold underneath the first material 3, the folding means located at a position upstream of the upper and lower sewing assemblies 230/280 and downstream of the tensioning bars 336.

Figure 32:
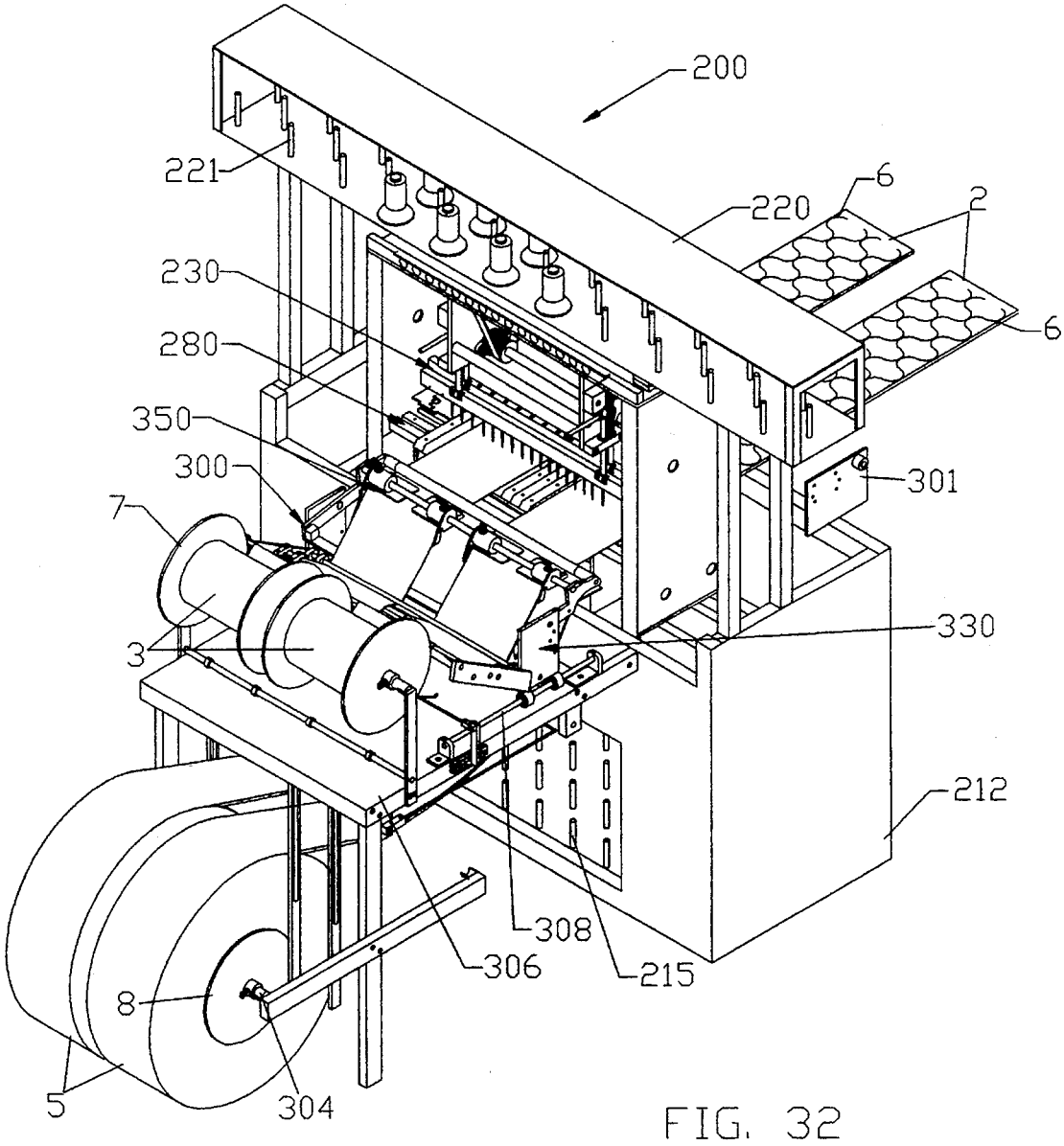

FIG. 32 shows the multi-needle border machine of FIG. 29 having a plurality of first 3 and second 5 materials thereon.

The foregoing detailed description is given primarily for clearness of understanding and no unnecessary limitations are to be understood therefrom for modifications call be made by those skilled in the art upon reading this disclosure and may be made without departing from the spirit of the invention and scope of the appended claims.

What is claimed is:

1. A multi-needle sewing machine, comprising:

a sewing frame carriage having at least one upper sewing assembly and a lower sewing assembly, said at least one upper sewing assembly having an upper main shaft passing therethrough, said lower sewing assembly having a lower main shaft passing therethrough, said sewing frame carriage having means for driving said upper and lower main shafts;

said at least one upper sewing assembly having a front needle bar having at least one needle connected thereto; said at least one upper sewing assembly having a corresponding front presser foot bar having at least one presser foot connected thereto; said at least one upper sewing assembly having a rear needle bar having at least one needle connected thereto; said at least one upper sewing assembly having a corresponding rear presser foot bar having at least one presser foot connected thereto;

said at least one upper sewing assembly having means for driving said front needle bar and said corresponding front presser foot bar and said rear needle bar and said corresponding rear presser foot bar vertically up and down, said driving means being coupled to said upper main shaft, where driving means moves said front needle bar with said corresponding front presser foot bar and said rear needle bar with said corresponding rear presser foot bar in an out of phase relationship;

said lower sewing assembly having a front spreader bar having at least one spreader connected thereto; said lower sewing assembly having a corresponding front looper bar having at least one looper connected thereto; said lower sewing assembly having a rear spreader bar having at least one spreader connected thereto; said lower sewing assembly having a corresponding rear looper bar having at least one looper connected thereto;

said lower sewing assembly having means for driving said front spreader bar in a first horizontal circle and said rear spreader bar in a second out of phase horizontal circle, said driving means being coupled to said lower main shaft;

said lower sewing assembly having means for driving said front looper bar in a left and right direction and means for rocking said front looper in a front and back direction, where said front looper bar moves in a first oblong pattern;

said lower sewing assembly means for driving said front looper bar in a left and right direction also driving said rear looper bar in an out of phase right and left direction, said means for rocking said front looper in a front and back direction also rocking said rear looper bar in an out of phase left and right direction, where said rear looper bar moves in a second out of phase oblong pattern;

said machine further having means for pulling a first material and a second material between said upper and lower sewing assemblies, said first material having opposed edges, said machine even further having means for placing said first material being pulled under tension and means for folding said opposed edges of said first material underneath said first material, where said machine sews through said first material and said opposed edges folded thereunder at preselected locations, thereby producing a sewn border piece.

2. The multi-needle sewing machine of claim 1, where said means for driving said front needle bar and said corresponding front presser foot bar and said rear needle bar and said corresponding rear presser foot bar vertically up and down further comprises:

at least two rotating front needle bar cranks having a first axis of rotation, at least two front needle bar shafts, each front needle bar shaft having a needle bar end and a crank end, said needle bar ends of said front needle bar being connected to said front needle bar, each said front needle crank and said corresponding front needle bar crank end having a connector link therebetween, each said connector link connected to said corresponding rotating front needle bar crank at a crank location different from said first axis of rotation;

at least two rotating rear needle bar cranks having a second axis of rotation, at least two rear needle bar shafts, each rear needle bar shaft having a needle bar end and a crank end, said needle bar ends of said rear needle bar being connected to said rear needle bar, each said rear needle crank and said corresponding rear needle bar crank end having a connector link therebetween, each said connector link connected to said corresponding rotating rear needle bar crank at a crank location different from said second axis of rotation;

where, said at least two rotating front needle bar cranks and said at least two rotating rear needle bar cranks rotate in a same direction.

3. The multi-needle sewing machine of claim 1, where said means for driving said front needle bar and said corresponding front presser foot bar and said rear needle bar and said corresponding rear presser foot bar vertically up and down further comprises:

at least two rotating front needle bar cranks having a first axis of rotation, at least two front needle bar shafts, each front needle bar shaft having a needle bar end and a crank end, said needle bar ends of said front needle bar being connected to said front needle bar, each said front needle crank and said corresponding front needle bar crank end having a connector link therebetween, each said connector link connected to said corresponding rotating front needle bar crank at a crank location different from said first axis of rotation;

at least two rotating rear needle bar cranks having a second axis of rotation, at least two rear needle bar shafts, each rear needle bar shaft having a needle bar end and a crank end, said needle bar ends of said rear needle bar being connected to said rear needle bar, each said rear needle crank and said corresponding rear needle bar crank end having a connector link therebetween, each said connector link connected to said corresponding rotating rear needle bar crank at a crank location different from said second axis of rotation;

where, said at least two rotating front needle bar cranks rotate in a first direction and said at least two rotating rear needle bar cranks rotate in a second direction, said second direction being opposed said first direction.

4. The multi-needle sewing machine of claim 1, where said means for driving said front spreader bar in a first horizontal circle and said rear spreader bar in a second out of phase horizontal circle further comprises at least two rotating front spreader bar shafts and at least two rotating rear spreader bar shafts, each of said front and rear spreader bar shafts having an axis of rotation, each of said front and rear spreader bar shafts having an end bore therein, each said end bore off-set a preselected distance from said axis of rotation, said front spreader bar connected to said front spreader bar shafts at said front spreader bar shafts end bores and said rear spreader bar connected to said rear spreader bar shafts at said rear spreader bar shafts end bores, said at least one of said rotating front spreader bar shafts and at least one of said rotating rear spreader bar shafts having a timing belt therebetween, at least one of said at least two front spreader bar shafts and said at least two rear spreader bar shafts being transversely coupled to said lower main shaft.

5. The multi-needle sewing machine of claim 4, where said at least one of said at least two front spreader bar shafts and said at least two rear spreader bar shafts has a rotating looper shaft transversely coupled thereto, said looper shaft having a looper shaft axis of rotation, said looper shaft having a front end and a rear end, each end having a looper crank connected thereto, each said looper crank having an off-set bore therein, each said off-set bore being a preselected distance from said looper shaft axis of rotation, each said looper crank off-set bore having a looper drive bar connected thereto, one of said looper drive bars being connected to said front looper bar, the other of said looper drive bars being connected to said rear looper bar, where said rotating looper shaft thereby rotates said looper cranks providing said means for driving said front looper bar in a left and right direction and said rear looper bar in an out of phase right and left direction.

6. The multi-needle sewing machine of claim 5, where said connection between said one of said looper drive bars and said front looper bar is an indirect connection, the respective looper drive bar and looper bar having a front looper pivot therebetween; and, where said connection between said other of said looper drive bars and said rear looper bar is an indirect connection, the respective looper drive bar and looper bar having a rear looper pivot therebetween.

7. The multi-needle sewing machine of claim 1, wherein said machine employs a plurality of sealed bearings and, therefore, requires no oiling.

8. The multi-needle sewing machine of claim 1, where said pulling means comprise a pair of opposed rotating rollers located at a downstream position from said upper and lower sewing assemblies, said sewn border piece being pulled therebetween; where said tensioning means comprises a plurality of parallel tensioning bars located at an upstream position from said upper and lower sewing assemblies, said first material and said tensioning bars being in a snaking relationship; and where said folding means comprises a pair of opposed folders having a first material guide therebetween, said opposed folders having facing lips, said lips causing said opposed edges of said first material to fold underneath said first material, said folding means located at a position upstream of said upper and lower sewing assemblies and downstream of said tensioning bars.

9. The multi-needle sewing machine of claim 1, further comprising means for simultaneously producing a plurality of sewn border pieces.

10. In combination with a multi-needle sewing machine of the type wherein a first material having opposed edges and an underneath second material are passed between an upper sewing assembly and a lower sewing assembly, said machine sewing a preselected pattern into said first and second materials, the improvement which comprises:

means for pulling said first material and said second material between said upper and lower sewing assemblies, means for placing said first material being pulled under tension, and means for folding said opposed edges of said first material underneath said first material, where said machine sews through said first material and said opposed edges folded thereunder at preselected locations, thereby producing a sewn border piece.

11. The multi-needle sewing machine of claim 10, where said pulling means comprise a pair of opposed rotating rollers located at a downstream position from said upper and lower sewing assemblies, said sewn border piece being pulled therebetween; where said tensioning means comprises a plurality of parallel tensioning bars located at an upstream position from said upper and lower sewing assemblies, said first material and said tensioning bars being in a snaking relationship; and where said folding means comprises a pair of opposed folders having a first material guide therebetween, said opposed folders having facing lips, said lips causing said opposed edges of said first material to fold underneath said first material, said folding means located at a position upstream of said upper and lower sewing assemblies and downstream of said tensioning bars.

12. The multi-needle sewing machine of claim 11, where said pulling means simultaneously pulls a plurality of first materials having opposed edges and a plurality of respective underneath second materials through said upper and lower sewing assemblies, where said tensioning means places said plurality of first materials under tension, and where said folding means folds said opposed edges of each of said plurality of first materials underneath said respective first material.

13. The multi-needle sewing machine of claim 10, where said pulling means simultaneously pulls a plurality of first materials having opposed edges and a plurality of respective underneath second materials through said upper and lower sewing assemblies, where said tensioning means places said plurality of first materials under tension, and where said folding means folds said opposed edges of each of said plurality of first materials underneath said respective first material.

* * * * *